US006010811A

United States Patent [19]

Baba et al.

[11] Patent Number: 6,010,811

[45] Date of Patent: Jan. 4, 2000

[54] TWO-COMPONENT TYPE DEVELOPER, DEVELOPING METHOD AND IMAGE FORMING METHOD

[75] Inventors: Yoshinobu Baba; Yuzo Tokunaga, both of Yokohama, Japan

[73] Assignee: Canon Kabushiki Kaisha, Tokyo, Japan

[21] Appl. No.: 08/910,211

[22] Filed: Aug. 13, 1997

Related U.S. Application Data

[63] Continuation-in-part of application No. 08/536,759, Sep. 29, 1995, abandoned.

[30] Foreign Application Priority Data

Oct. 5, 1994 [JP] Japan ..... 6-264428

[51] Int. Cl.[7] ..... G03G 9/107

[52] U.S. Cl. ..... 430/106.6; 430/108; 430/111; 430/45; 430/122

[58] Field of Search ..... 430/106.6, 108, 430/111, 45, 122

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 5,108,862 | 4/1992 | Kishimoto et al. | 430/108 |
| 5,164,774 | 11/1992 | Tomita et al. | 430/111 |
| 5,319,424 | 6/1994 | Tomiyama et al. | 430/111 |
| 5,340,677 | 8/1994 | Baba et al. | 430/106.6 |
| 5,346,791 | 9/1994 | Ozawa et al. | 430/106.6 |
| 5,439,771 | 8/1995 | Baba et al. | 430/106.6 |
| 5,464,720 | 11/1995 | Baba et al. | 430/122 |
| 5,470,687 | 11/1995 | Mayama et al. | 430/137 |
| 5,482,806 | 1/1996 | Suzuki et al. | 430/106.6 |
| 5,654,120 | 8/1997 | Hakata et al. | 430/106.6 |

FOREIGN PATENT DOCUMENTS

| | | |
|---|---|---|
| 0317667 | 5/1989 | European Pat. Off. . |
| 0384697 | 8/1990 | European Pat. Off. . |
| 59-104663 | 6/1984 | Japan . |
| 5-8424 | 2/1993 | Japan . |

OTHER PUBLICATIONS

Diamond, Arthur S. (editor) Handbook of Imaging Materials. New York: Marcel—Dekker, Inc. p. 178. 1991.

Patent Abstracts of Japan, vol. 13, No. 368 (P–919) Aug. 1989 for JP 1–124868.

Patent Abstracts of Japan, vol. 6, No. 255 (P–154) [1103] Nov. 1982 for for JP–57–128347.

Patent Abstracts of Japan, vol. No. 14, No. 88 (P–1008) [4031] Feb. 1990 for JP 1–297657.

Database WPI, Section Ch., Week 9224, Derwent Publications, AN 92–196183 JP 4–124677.

*Primary Examiner*—Christopher D. Rodee

*Attorney, Agent, or Firm*—Fitzpatrick, Cella, Harper & Scinto

[57] ABSTRACT

A two-component type developer for developing an electrostatic image is constituted by at least a toner and a magnetic carrier. The toner has a weight-average particle size D4 of at most 10 $\mu$m and a number-average particle size D1 satisfying $D4/D1 \leqq 1.5$. The magnetic carrier comprises composite particles comprising magnetic iron compound particles, non-magnetic metal oxide particles, and a binder comprising a phenolic resin. The composite particles contain the magnetic iron compound and the non-magnetic metal oxide in a total proportion of 80–99 wt. %. The magnetic iron compound particles have a number-average particle size ra, and the non-magnetic metal oxide particles have a number-average particle size $r_b$ satisfying $r_b/r_a > 1.0$.

43 Claims, 3 Drawing Sheets

TWO-COMPONENT TYPE DEVELOPER, DEVELOPING METHOD AND IMAGE FORMING METHOD

This application is a continuation-in-part of application Ser. No. 08/536,759 filed Sep. 29, 1995, now abandoned.

FIELD OF THE INVENTION AND RELATED ART

The present invention relates to a two-component type developer for developing electrostatic images in electrophotography, electrostatic recording, etc., a developing method and an image forming method.

Hitherto, various electrophotographic processes have been disclosed in U.S. Pat. Nos. 2,297,691; 3,666,363; 4,071,361; etc. In these processes, an electrostatic latent image is formed on a photoconductive layer by irradiating a light image corresponding to an original, and a toner is attached onto the latent image to develop the latent image. Subsequently, the resultant toner image is, after being transferred onto a transfer material such as paper, as desired, fixed , e.g., by heating, pressing, or heating and pressing, or with solvent vapor, to obtain a copy or a print.

In the step of developing the latent image, charged toner particles are caused to form a toner image by utilizing an electrostatic function of the electrostatic latent image. In the methods of developing electrostatic latent images by using toners in general, a two-component type developer comprising a toner and a carrier in mixture is suitably used in a full color copier or printer required of high image qualities.

In recent years, accompanying the advances in computer technology, high definition television technology, etc., there have been desired means for outputting full color images of higher resolution. For this purpose, efforts have been made so as to provide full color images of toner having higher quality and higher resolution comparable with those of silver salt photographic images. In compliance with these demands, various studies have been made from the aspects of process and developer.

Regarding the developer for example, a representative effort may be to use a toner and a carrier having smaller particle sizes. However, the use of a smaller particle size toner provides an increased difficulty in powder handling and increased difficulties in optimization of electrophotographic performances, such as those of transfer and fixing other than development. Accordingly, the improvement in image quality by an improvement in toner alone poses a certain limit.

On the other hand, as an effort for improvement in respect of an electrophotographic process, there may be raised a possibility of accomplishing a higher image quality by densifying a magnetic brush on a developer-carrying member, such as a developing sleeve. The densification of the magnetic brush may be accomplished by effecting a development at a part between magnetic poles in the developing sleeve or use of a smaller strength of magnetic poles in the developing sleeve from a process aspect. These measures may suppress the influence of magnetic brush but may be accompanied with difficulties because of insufficient constraint of the developer, such as scattering and poor conveyance performance. Thus, these cannot be simply adopted. The densification of magnetic brush may also be accomplished by use of magnetic carrier particles having a smaller particle size or a lower magnetic force.

For example, Japanese Laid-Open Patent Application (JP-A) 59-104663 has proposed the use of a magnetic carrier having a small saturation magnetization. If a magnetic carrier having a small saturation magnetization is simply used, the thin-line reproducibility may be improved but, as the constraint of magnetic carrier particles on the developing sleeve is weakened, a so-called "carrier attachment" phenomenon of the magnetic carrier being transferred to a photosensitive drum to cause an image defect is liable to occur.

It is also known that the carrier attachment is also liable to be caused when a magnetic carrier of a small particle size is used. Japanese Patent Publication (JP-B) 5-8424 for example has proposed to use a magnetic carrier and a toner of smaller particle sizes to effect a non-contact development under a vibrating electric field. The JP-B reference contains a description to the effect that the case of a magnetic carrier having a higher resistivity is effective for improving the carrier attachment in a developing process using a vibrating electric field. The use of such a magnetic carrier having a higher specific resistance has been found insufficient in improving the carrier attachment to provide higher image qualities in some cases, particularly where a carrier core having a low specific resistance is exposed to the surface even in a small proportion. In this method adopting a non-contact developing scheme, fairly good image densities can be attained to provide images free from the carrier attachment in case where the magnetic carrier is provided with a large magnetization strength at the magnetic pole but the image densities are liable to be lowered significantly when the magnetization strength of the magnetic carrier is decreased.

Generally, a magnetic resin carrier is caused to have a bulk resistivity which is higher than those of the carriers having iron powder core or metal oxide core (of, e.g., ferrite, magnetite). In such a case of using, e.g., a magnetic resin carrier allowed to contain an increased amount of magnetic material by using a magnetic material having different particle diameter ratios, it is possible to provide a higher magnetic constraint force if the internally added magnetic material comprises a magnetic material having a low resistivity. However, the use of such a magnetic carrier has failed in sufficiently improving the carrier attachment in some cases when used in a developing process utilizing an alternating magnetic field.

As described above, various measures have been taken in order to realize higher image qualities while preventing the carrier attachment, it has been still desired to provide a two-component type developer having solved the above-mentioned problems.

SUMMARY OF THE INVENTION

Accordingly, a generic object of the present invention is to provide a two-component type developer having solved the above-mentioned problems.

A more specific object of the present invention is to provide a two-component type developer capable of obviating the carrier attachment and preventing or suppressing the occurrence of fog to provide high-quality toner images.

Another object of the present invention is to provide a two-component type developer capable of effectively preventing toner scattering.

Another object of the present invention is to provide a two-component type developer having a prolonged life and causing little image quality degradation in copying or printing on a large number of sheets.

A further object of the present invention is to provide a developing method and an image forming method using such a two-component type developer as described above.

According to the present invention, there is provided a two-component type developer for developing an electrostatic image, comprising: at least a toner and a magnetic carrier; wherein the toner has a weight-average particle size D4 of at most 10 $\mu$m and a number-average particle size D1 satisfying $D4/D1 \leqq 1.5$; and the magnetic carrier comprises composite particles comprising magnetic iron compound particles, non-magnetic metal oxide particles, and a binder comprising a phenolic resin; the composite particles containing the magnetic iron compound and the non-magnetic metal oxide in a total proportion of 80–99 wt. %; the magnetic iron compound particles having a number-average particle size ra, the non-magnetic metal oxide particles having a number-average particle size $r_b$ satisfying $r_b/r_a>1.0$.

According to another aspect of the present invention there is provided a developing method for developing an electrostatic image, comprising the steps of:

carrying the above-mentioned two-component type developer by a developer-carrying member enclosing therein a magnetic field generating means, forming a magnetic brush of the two-component type developer on the developer-carrying member, causing the magnetic brush to contact a latent image-bearing member, and developing an electrostatic image on the latent image-bearing member to form a toner image while applying an alternating electric field to the developer-carrying member.

According to a further aspect of the present invention, there is provided an image forming method wherein the above-mentioned steps are repeated with at least a magenta developer, a cyan developer, and a yellow developer respectively, each satisfying the requirements of the above-mentioned two-component type developer, and a full color image is formed at least with the resultant magenta toner image, cyan toner image and yellow toner image.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
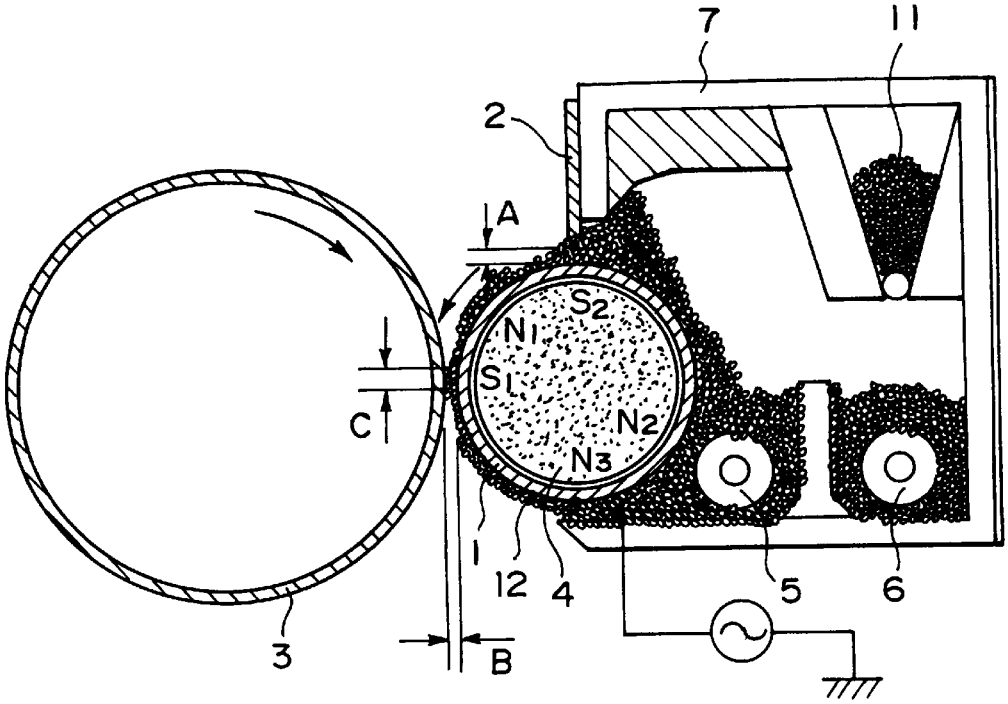
FIG. 1 is a schematic view of an apparatus for practicing an embodiment of the developing method according to the present invention.

In the present invention, the above-mentioned objects have been accomplished by a two-component type developer of which the toner and the magnetic carrier have been improved in combination.

As a result of our detailed study, it has been clarified that the driving force of carrier attachment in a contact developing process under application of an alternating magnetic field is caused by charge injection from the developing sleeve to the magnetic carrier as a controlling factor under application of the developing bias voltage. Regarding the reproducibility of dots in a digital latent image, it has been also found that the deterioration of the dot reproducibility is caused by leakage of charge from the electrostatic latent image on the photosensitive drum due to rubbing of the photosensitive drum surface with the magnetic carrier so that dots of the digital latent image are deformed into ununiform shapes. Even in the case of using a carrier core having a high bulk resistivity, such as a magnetic material-dispersed resin carrier, the charge may be leaked via the magnetic particles if the magnetic material has a low resistivity like magnetite.

In order to simultaneously solve these problems, the present invention uses a magnetic carrier comprising composite particles such that the composite particles comprise magnetic iron compound particles, non-magnetic metal oxide particles, and a binder comprising a phenolic resin; and the composite particles contain the magnetic iron compound and the non-magnetic metal oxide in a total proportion of 80–99 wt. %; the magnetic iron compound particles having a number-average particle size ra, the non-magnetic metal oxide particles having a number-average particle size $r_b$ satisfying $r_b/r_a>1.0$. As a result, the higher-resistivity non-magnetic metal oxide particles are caused to be preferentially present at the carrier particle surface, so as to effectively increase the carrier resistivity. For this reason, the developer according to the present invention is effective in preventing charge injection into the carrier and preventing carrier attachment to faithfully reproducing an electrostatic latent image.

By causing the non-magnetic metal oxide particles to be preferentially present at the carrier surface or core surface than at the central or inner part of the carrier particles, the carrier surface can be provided with a higher resistivity than in the case where the magnetic iron oxide particles are exposed to the carrier or core surface, thereby effectively preventing the charge injection.

As for the prevention of fog and toner scattering and improvement in dot reproducibility in final images, by causing the non-magnetic metal oxide particles having a relatively large particle size to be present preferentially at the surface, the magnetic carrier particle surfaces are provided with minute unevenness so as to better carry the toner particles. By this improvement together with the improvement in toner, it has become possible to improve the charging of the toner and image qualities of final images after transfer and fixing steps subsequent to the development in an electrophotographic process.

By using a toner having a weight-average particle size D4 of at most 10 $\mu$m and a sharp particle size distribution as represented by a number-average particle size D1 satisfying a ratio D4/D1 of at most 1.5 in combination with a magnetic carrier comprising composite particles comprising magnetic iron oxide particles and, non-magnetic metal oxide particles bound by a phenolic resin, it is possible to provide a two-component type developer free from fog or toner scattering and providing a good dot reproducibility. This is presumably because the triboelectric charge distribution of toner is made sharp by narrowing the toner particle size distribution and the charging of the toner is better performed to provide a sharper triboelectric charge distribution because the composite particles in charge of triboelectrification is provided with minute surface unevenness.

The developer according to the present invention is barely deteriorated and can continually provide high-quality images similarly as at the initial stage presumably for the following reason.

It is considered that a developer is deteriorated during a long period of use thereof because the toner and the magnetic carrier are damaged primarily due to a magnetic shear or gravitational shear acting between the toner and the carrier or between the carrier particles in the developing vessel. The toner is basically consumed, but the magnetic carrier is repeatedly used without being consumed so that the damage given to the surface thereof is accumulated.

However, if a magnetic carrier comprising composite particles formed of a magnetic iron compound, a non-magnetic metal oxide and phenolic resin is used in combination with a toner having a sharp particle size distribution, the magnetic shear acting between the toner and the carrier and between the carrier particles may be reduced to reduce the surface damage exerted to the carrier particles.

Particularly, the magnetic carrier particles used in the present invention are provided with a surface unevenness of fine particles inclusive of magnetic particles and non-magnetic metal oxide particles so that, when the magnetic carrier particles are coated with a resin, the adhesion between the magnetic carrier particles (core particles) and the coating resin is improved to suppress the peeling of the coating resin layer.

A smaller particle size of magnetic carrier is preferred from the viewpoint of a higher image quality but is liable to increase the carrier attachment based on a relation between the magnetic force and the particle size. From these viewpoints in combination, the magnetic carrier used in the present invention may have a number-average particle size in the range of 1–1000 $\mu$m and may preferably have a number-average particle size of 1–300 $\mu$m, so as to provide high image quality. A number-average particle size of 5–100 $\mu$m is further suitable from the viewpoints of higher image quality, carrier attachment prevention and prevention of developer deterioration during continuous image formation. If the magnetic carrier has a number-average particle size in excess of 1000 $\mu$m, the specific surface area of the magnetic brush rubbing the photosensitive drum is reduced, thus being liable to fail in supplying a sufficient amount of toner and leave rubbing traces with the magnetic brush, so that this is not desirable from the viewpoints of high density and high image quality. A magnetic carrier having a number-average particle size smaller than 1 $\mu$m is liable to cause the carrier attachment because of a smaller particle size per carrier particle. The method of measuring the particle size of magnetic carrier particles relied on herein will be described hereinafter.

As for the magnetic properties of the magnetic carrier used in the present invention, it may be appropriate to use a magnetic carrier having a saturation magnetization ($\sigma_s$) of 10–80 emu/cm$^3$. It is further preferred to use a magnetic carrier having a saturation magnetization of 15–60 emu/cm$^3$. The magnetization of the magnetic carrier may be appropriately selected depending on the particle size of the carrier. While being also affected by the particle size, a magnetic carrier having a magnetization in excess of 80 emu/cm$^3$ is liable to result in a magnetic brush formed on a developer sleeve at developing pole having a low density and comprising rigid ears, thus being liable to result in rubbing traces in the resultant toner images and image defects, such as roughening of halftone images and irregularity of solid images, particularly due to deterioration in long continuous image formation on a large number of sheets. Below 10 emu/cm$^3$, the magnetic carrier is caused to exert only an insufficient magnetic force to result in toner attachment or a lower toner-conveying performance.

The magnetic properties referred to herein are values measured by using an oscillating magnetic field-type magnetic property auto-recording apparatus ("BHV-30", available from Riken Denshi K.K.). Specific conditions for the measurement will be described hereinafter.

It is preferred that the magnetic carrier used in the present invention has an (electrical) resistivity of at least $1\times10^{12}$ ohm.cm at an electric field intensity of $5\times10^4$ V/m. If the resistivity is below $1\times10^{12}$ ohm.cm, the above-mentioned carrier attachment and a lower dot-reproducibility due to charge leakage from the latent image in the process of development are liable to be caused. The method of measuring the resistivity of magnetic carrier referred to herein will be described hereinafter.

The magnetic iron component constituting the core of the magnetic carrier may preferably comprise an iron-containing metal alloy, magnetite or ferrite showing magnetism as represented by a general formula of $MO.Fe_2O_3$ or $MFe_2O_4$, wherein M denotes a divalent or monovalant metal, such as Mn, Fe, Ni, Co, Cu, Mg, Zn, Cd, or Li. M denotes a single species or plural species of metals. Specific examples thereof may include alloys, such as silicon steel, permalloy, sendust, Fe—Co and alnico; and iron-based oxide materials, such as magnetite, $\gamma$-iron oxide, Mn—Zn-based ferrite, Ni—Zn-based ferrite, Mn—Mg-based ferrite, Li-based ferrite, and Cu—Zn-based ferrite. Among these, magnetite is most preferably used.

The magnetic iron component used in the present invention may preferably have a saturation magnetization of at least 30 emu/g.

Examples of the non-magnetic metal oxide may include: one or plural species of metals, such as Mg, Al, Si, Ca, Sc, Ti, V, Cr, Mn, Fe, Co, Ni, Cu, Zn, Sr, Y, Zr, Nb, Mo, Cd, Sn, Ba and Pb. Specific examples of the non-magnetic metal oxides may include: $Al_2O_3$, $SiO_2$, CaO, $TiO_2$, $V_2O_5$, $CrO_2$, $MnO_2$, $Fe_2O_3$, CoO, NiO, ZnO, SrO, $Y_2O_3$ and $ZrO_2$.

The above-mentioned magnetic iron compound and non-magnetic metal oxide may preferably be dispersed in a resin to form carrier core particles. In this instance, it is preferred to use plural species of particles having similar shapes in order to provide an increased adhesion and a high carrier strength. Examples of preferred combination may include: magnetite and hematite ($\alpha$-$Fe_2O_3$), magnetite and $\gamma$-$Fe_2O_3$, magnetite and $SiO_2$, magnetite and $Al_2O_3$, magnetite and $TiO_2$, and magnetite and Cu—Zn-based ferrite. Among these, the combination of magnetite and hematite is preferred in view of the price and the resultant carrier strength.

In the case of dispersing the magnetic iron compound and the non-magnetic metal oxide in a resin to form a carrier core, the magnetic iron compound particles have a number-average particle size $r_a$ and the non-magnetic metal oxide particles have a number-average particle size $r_b$ satisfying a ratio $r_b/r_a$ exceeding 1.0. If the ratio is 1.0 or below, the magnetic iron compound particles generally having a lower resistivity are liable to be exposed to the surface, thus failing to achieve an increased resistivity of the carrier and prevent the carrier attachment. A larger $r_b/r_a$ ratio is preferred so that the larger non-magnetic metal oxide particles appear at the carrier particle surface to prevent carrier injection into the carrier, thereby preventing the carrier attachment and a lowering in dot reproducibility due to charge leakage from the latent image. A $r_b/r_a$ ratio of 1.2–5.0 is further preferred in order to provide a good combination of the effect of increasing the magnetic carrier resistivity and a reinforcement of carrier strength. The above-preferred particle size ratio range is based on a discovery that, when filler particles of different sizes are simultaneously blended and dispersed in a resin to form carrier (core) particles, the particles of a larger particle size are preferentially present at the carrier (core) surface. Accordingly it is important that the non-magnetic metal oxide particles having a higher resistivity have a larger particle size than that of the magnetic iron compound particles. The number-average particle size $r_a$ of the magnetic iron compound may preferably be 0.02–5 $\mu$m while it can be varied depending on the carrier particle size. The non-magnetic metal oxide particles may preferably have a number-average particle size $r_b$ of 0.05–10 $\mu$m. The method of measuring the particle size of metal oxides referred to herein will be described hereinafter.

By selectively forming a layer of the non-magnetic metal oxide particles at the carrier (core) particle surface rather than inside the carrier particle, it becomes possible to provide a higher resistivity and effectively suppress the charge injection.

More specifically, it is preferred that a total volume Pa1 of magnetic iron compound particles and a total volume Pb1 of non-magnetic metal oxide particles respectively appearing in an inside part of a carrier (core) particle section, and a total volume Pa2 of magnetic iron compound particles and a total volume Pb2 of non-magnetic metal oxide particles respectively appearing at a surface part of the carrier (core) particle section are set to satisfy Pb1l/Pa1<1 and Pb2/Pa2>1, so as to provide a higher resistivity.

Regarding the resistivities of the magnetic iron compound and the non-magnetic metal oxide used by dispersion in a resin, the magnetic iron compound particles may preferably have a resistivity of at least $1\times10^3$ ohm.cm and the non-magnetic metal oxide particles may preferably have a resistivity higher than that of the magnetic iron compound particles. More preferably, the non-magnetic metal oxide particles may have a resistivity of at least $10^8$ ohm.cm. If the magnetic particles have a resistivity below $1\times10^3$ ohm.cm, it is difficult to have a desired resistivity of carrier even if the amount of the magnetic iron compound dispersed is reduced, thus being liable to cause charge injection leading to inferior image quality and inviting carrier attachment. If the metal oxide having a larger particle size has a resistivity below $1\times10^8$ ohm.cm, it becomes difficult to sufficiently increase the carrier core resistivity, thus being difficult to accomplish the above-mentioned effect. The method of measuring resistivities of metal oxides referred to herein will be described hereinafter.

The magnetic carrier contains the magnetic iron compound and the non-magnetic metal oxide in a total content of 80–99 wt. %. If the total content is below 80 wt. %, the carrier (core) particles are liable to agglomerate with each other during the particle formation thereof, particularly by direct-polymerization. This can lead to a fluctuation in particle size distribution and a failure in good triboelectrification. Above 99 wt. %, the resultant carrier strength is lowered, and problems, such as carrier cracking, are liable to occur during continuous image formation on a large number of sheets.

In order to better attain the effect of the present invention, in the resinous carrier containing the magnetic iron compound and the non-magnetic metal oxide in a dispersed state, it is preferred that the non-magnetic metal oxide particles occupy 5–70 wt. % of the total of the magnetic iron compound particles and the non-magnetic metal oxide particles. Below 5 wt. %, it becomes difficult to increase the resistivity of the carrier (core). Above 70 wt. %, the resultant magnetic carrier can have only a small magnetic force, thus being liable to invite the carrier attachment.

The magnetic carrier according to the present invention may preferably have a bulk density of 1.0–2.0 g/cm$^3$. Below 1.0 g/cm$^3$, the carrier attachment is liable to be cause while it can depend on the magnetic force. Above 2.0 g/cm$^3$, the resultant developer is liable to be deteriorated during continuous image formation on a large number of sheets while it can also depend on the magnetic force of the magnetic carrier. The bulk density of a magnetic carrier may be measured according to JIS K5101.

In the present invention, the magnetic carrier is constituted by using phenolic resin as a binder resin.

The magnetic carrier used in the present invention may for example, be prepared by mixing a monomer (i.e., a binder resin precursor), a magnetic iron compound and a non-magnetic metal oxide, and subjecting the mixture to polymerization to directly produce carrier core particles. The monomer for the polymerization may comprise a combination of a phenol and an aldehyde. More specifically, for producing carrier (core) particles comprising a cured phenolic resin a mixture of a phenol, an aldehyde, a magnetic iron compound and a non-magnetic metal oxide may be subjected to suspension polymerization in the presence of a basic catalyst and a dispersion stabilizer in an aqueous medium. In order to provide a high-resistivity magnetic carrier, it is preferred to form composite particles through a two-step polymerization process wherein a magnetic iron compound is first subjected to polymerization for particle formation to form a slurry, and a monomer, a non-magnetic metal oxide and another additive, if any, are added to the slurry to effect a second step polymerization, or a three or more step polymerization process for repeating the above steps. Examples of the phenols as a monomer may include phenol, resorcinol; alkylphenols, such as m-cresol, p-tert-butylphenol, o-propylphenol, and alkylphenols, and derivatives of these. Among these, phenol is particularly preferred because of a particle forming characteristic and a cost.

In order to strengthen the carrier core and facilitate a resin coating thereon, the phenolic resin may be crosslinked.

The magnetic carrier used in the present invention may preferably be in a coated form with an appropriate coating resin selected according to the chargeability of the toner used in the present invention. The coating can also be effected by using a resin containing non-magnetic metal oxide particles in order to control the resistivity of the carrier core or improve the lubricity of the magnetic carrier. Such a resin-coated magnetic carrier may be effective in preventing charge injection into the magnetic carrier, preventing an excessively high resistivity of the carrier an excessive charge of the magnetic carrier and stabilizing the triboelectric charge of the toner. The non-magnetic metal oxide dispersed in such a coating resin may comprise one or more species in mixture selected from the above-mentioned metal oxides. It is further preferred to use $SiO_2$, $Al_2O_3$, $TiO_2$ or $\alpha$-$Fe_2O_3$ having a good flowability, or utilize the non-magnetic metal oxide used in the carrier core for improving the adhesion of the coating resin. THe coating amount of such a coating material may suitably be 0.5–10 wt. %, particularly 0.6–5 wt. %, based on the carrier core weight.

If the coating amount is below 0.5 wt. %, it is difficult to sufficiently coat the carrier core particles and control the ability of triboelectrically charging the toner with the coating resin. In excess of 10 wt. %, the resistivity may be in a desired range, but there may result in a lower flowability and image deterioration after continuous image formation on a large number of sheets, because of an excessive resin coating rate.

The coating resin used in the present invention may suitably be an insulating resin, which may be either a thermoplastic resin or a thermosetting resin. Examples of the thermoplastic resin may include: polystyrene; acrylic resins, such as polymethyl methacrylate, and styrene-acrylic acid copolymer; styrene-butadiene copolymer, ethylene-vinyl acetate copolymer, vinyl chloride resin, vinyl acetate resin, polyvinylidene fluoride resin, fluorocarbon resin, perfluorocarbon resin, solvent-soluble perfluorocarbon resin, polyvinyl alcohol, polyvinyl acetal polyvinylpyrrolidone, petroleum resin, cellulose; cellulose derivatives, such as cellulose acetate, nitrocellulose, methyl cellulose, hydroxymethyl cellulose, hydroxyethyl cellulose, and hydroxypropyl cellulose; novolak resin, low-molecular weight polyethylene, saturated alkyl polyester resins; aromatic polyester resins, such as polyethylene terephthalate, polybutylene terephthalate, and polyarylate; polyamide resin, polyacetal resin, polycarbonate resin, polyethersulfone resin, polysulfone resin, polyphenylene sulfide resin, and polyether ketone resin.

Examples of the thermosetting (or curable resin may include: phenolic resin, modified phenolic resin, maleic resin, alkyd resin, epoxy resin, acrylic resin, unsaturated polyesters obtained by polycondensation among maleic anhydride, terephthalic acid and polyhydric alcohol, urea resin, melamine resin urea-melamine resin, xylene resin, toluene resin, guanamine resin, melamine-guanamine resin, acetoguanamine resin, glyptal resin, furan resin, silicone resin, polyimide resin, polyamideimide resin, polyetherimide resin, and polyurethane resin.

The above-mentioned thermoplastic resins or thermosetting resins may be used singly or in mixture. It is also possible to use a mixture of a thermoplastic resin and a curing or hardening agent to provide a cured resin.

The coated magnetic carrier may preferably be produced through by spraying a coating resin solution onto carrier core particles in a floating or fluidized state to form a coating film on the core particle surfaces, or spray drying.

Other coating methods may include gradual evaporation of the solvent in a coating resin solution in the presence of a metal oxide under application of a shearing force. More specifically, the solvent evaporation may be performed at a temperature above the glass transition point of the coating resin, and the resultant clustered metal oxide particles may be then disintegrated. Alternatively, the coating film may be cured under heating, followed by disintegration.

The metal oxide may have a particle shape suitably selected for a developing system used. However, the metal oxide used in the present invention may preferably have a sphericity of at most 2. If the sphericity exceeds 2, the resultant developer is caused to have a poor fluidity and provides a magnetic brush of an inferior shape, so that it becomes difficult to obtain high-quality toner images. The sphericity of a carrier may be measured, e.g., by sampling 300 carrier particles at random through a field-emission scanning electron microscope (e.g., "S-800", available from Hitachi K.K.) and measuring an average of the sphericity defined by the following equation by using an image analyzer (e.g., "Luzex 3", available from Nireco K.K.):

Sphericity(SF1)=$[(\text{MX LNG})^2/\text{AREA}]\times\pi/4$, wherein MX LNG denotes the maximum diameter of a carrier particle, and AREA denotes the projection area of the carrier particle. As the sphericity is closer to 1, the shape is closer to a sphere.

The toner used in the present invention may have a weight-average particle size (D4) of at most 10 $\mu$m, preferably 3–8 $\mu$m. Further, it is important that the weight-average particle size (D4) and the number-average particle size (D1) provides a ratio (D4/D1) of at most 1.5.

If the toner has a weight-average particle size (D4) exceeding 10 $\mu$m, the toner particles for developing electrostatic latent images become so large that development faithful to the latent images cannot be performed and toner scattering is liable to be caused.

If the ratio (D4/D1) of the weight-average particle size (D4) to the number-average particle size (D1) of a toner exceeds 1.5, the toner is caused to have a broad charge distribution, thus being liable to cause difficulties, such as charging failure and particle size deviation of developing toner particles. The weight-average particle size and number-average particle size of toners may be measured, e.g., by using a Coulter counter. Details thereof will be described later.

The toner used in the present invention, may comprise a binder resin, examples of which may include: polystyrene; polymers of styrene derivatives, such as poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, and styrene-acrylonitrile-indene copolymer; polyvinyl chloride, phenolic resin, natural or modified phenolic resin, natural or modified maleic acid resin, acrylic resin, methacrylic resin, polyvinyl acetate, silicone resin; polyester resins having a structural unit selected from, aliphatic polyhydric alcohols, aromatic polyhydric alcohols or diphenols, and aliphatic dicarboxylic acids or aromatic dicarboxylic acids; polyurethane resin, polyamide resin, polyvinyl butyral, terpene resin, coumarone-indene resin and petroleum resin. Crosslinked resins, such as styrene-based resins and crosslinked polyester resins, may also be used.

Examples of the comonomer to be used in combination with a styrene monomer for providing styrene copolymers may include vinyl monomers, including: acrylic acid; acrylic acid esters or derivatives thereof, such as methyl acrylate, ethyl acrylate, butyl acrylate, dodecyl acrylate, octyl acrylate, 2-ethylhexyl acrylate, phenyl acrylate, methyl methacrylate, ethyl methacrylate, butyl methacrylate, octyl methacrylate, acrylonitrile, methacrylonitrile, and acrylamide; maleic acid; half esters and diesters of maleic acid, such as butyl maleate, methyl maleate, and dimethyl maleate; vinyl esters, such as vinyl acetate and vinyl chloride; vinyl ketones, such as vinyl methyl ketone, and vinyl hexyl ketone; and vinyl ethers, such as vinyl methyl ether and vinyl ethyl ether.

The crosslinking agent may principally comprise a compound having at least two polymerizable double bonds. Examples thereof may include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol dimethacrylate; divinyl compounds, such as divinylaniline, divinyl ether, divinyl sulfide and divinyl sulfone; and compounds having three or more ethylenic double bonds. These compounds may be used alone or in mixture. At the time of synthesis of a binder resin, the crosslinking agent may preferably be used in a proportion of 0.01–10 wt. %, further preferably 0.05–5 wt. %, based on the binder resin.

In the case of using a pressure-fixation system, it is possible to use a binder resin for a pressure-fixable toner, examples of which may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyester, paraffin, and other waxes.

The toner used in the present invention can be used in combination with a charge control agent which is incorporated in (internally added to) or blended with (externally added to) the toner particles. By the addition of a charge control agent, it becomes possible to effect an optimum charge control depending on a developing system used. Examples of a positive charge control agent may include: nigrosine and modified products thereof with aliphatic acid metal salts; quaternary ammonium salts, such as tributylbenzylammonium-1-hydroxy-4-naphthosulfonate, and tetrabutylammonium tetrafluoroborate; diorganotin oxides, such as dibutyltin oxide, dioctyltin oxide, dicyclohexyltin oxide; dibutyltin borate, dioctyltin borate, and dicyclohexyltin borate. These compounds may be used singly or in combination of two or more species. Among these, nigrosine-based compounds and quaternary ammonium salts are particularly preferred.

Alternatively, in the present invention, it is also possible to use a negative charge control agent, such as organic metal salts, organic metal complexes, and chelate compounds. Among these, acetylacetone metal complexes (inclusive of monoalkyl-substituted and dialkyl-substituted derivatives), salicylic acid metal complexes (inclusive of monoalkyl-substituted and dialkyl-substituted derivatives), and their corresponding salts are preferred. Salicylic acid-based metal complexes or salicylic acid-based metal salts are particularly preferred. Specific examples of preferred negative charge control agent may include: aluminum acetylacetonate, iron (II) acetylacetonate, 3,5-di-tert-butylsalicylic acid chromium complex or salt, and 3,5-di-tert-butylsalicylic acid zinc complex or salt.

When internally added to the toner, the above charge control agent may preferably be used in a proportion of 0.1–20 wt. parts, particularly 0.2–10 wt. parts, per 100 wt. parts of the binder resin. When used for color image formation, it is preferred to use a colorless or pale-colored charge control agent.

As the colorant for the toner, it is possible to use a dye and/or a pigment known heretofore. Examples thereof may include: carbon black, Phthalocyanine Blue, Peacock Blue, Permanent Red, Lake Red, Rhodamine Lake, Hansa Yellow, Permanent Yellow and Benzidine Yellow. The colorant may be added in an amount of 0.1–20 wt. parts, preferably 0.5–20 wt. parts, per 100 wt. parts of the binder resin. In order to provide a fixed toner image having a good transparency or an OHP film, the colorant may preferably be added in a proportion of at most 12 wt. parts, further preferably 0.5–9 wt. parts, per 100 wt. parts of the binder resin.

The toner constituting the developer according to the present invention can further contain a wax, such as polyethylene, low-molecular weight polypropylene, microcrystalline wax, carnauba wax, sasol wax or paraffin wax in order to improve the releasability at the time of hot pressure fixation.

The toner used in the present invention may suitably be used in mixture with fine powder externally added thereto, inclusive of fine particles of inorganic materials, such as silica, alumina and titanium oxide; and fine particles of organic materials, such as polytetrafluoroethylene, polyvinylidene fluoride, polymethyl methacrylate, polystyrene and silicone resin. If such fine powder is externally added to the toner, the fine powder is caused to be present between the toner and carrier particles, or between the toner particles, so that the developer may be provided with an improved flowability and an improved life. The above-described fine powder may preferably have an average particle size of at most 0.2 $\mu$m. If the average particle size exceeds 0.2 $\mu$m, the flowability-improving effect is scarce, and the image quality can be lowered due to insufficient flowability during development or transfer in some cases. The method of measuring the particle size of such fine powder referred to herein will be described hereinafter.

Such fine powder may preferably have a specific surface area of at least 30 $m^2/g$, particularly 50–400 $m^2/g$, as measured by the BET method using nitrogen adsorption. The fine powder may suitably be added in a proportion of 0.1–20 wt. parts per 100 wt. parts of the toner.

In preparing the toner constituting the developer according to the present invention, the binder resin of a vinyl-type or non-vinyl-type thermoplastic resin, a colorant, an optional charge control agent and other additives may be sufficiently blended in a mixer and then melt-kneaded by a hot kneading means, such as heated rollers, a kneader or an extruder to compatibly knead the resins and disperse or dissolve therein the pigment or dye. The thus-kneaded product is thereafter cooled for solidification, pulverized and classified to obtain toner particles. For the toner classification, it is preferred to use a multi-division classification apparatus utilizing an inertia force (the Coanda effect). By using the apparatus, a toner having the particle size distribution defined by the present invention can be produced efficiently.

The toner particles thus obtained can be used as they are but may preferably be used in mixture with fine powder externally added thereto as described above.

The mixing of the toner and the fine powder may be effected by using a blender, such as a Henschel mixer. The resultant toner carrying such an external additive is mixed with the magnetic carrier to provide a two-component type developer. In the two-component type developer, the toner may preferably occupy 1–20 wt. %, more preferably 1–10 wt. %, in a typical case while it can depend on the developing process. The toner in the two-component type developer may suitably be provided with a triboelectric charge of 5–100 $\mu$C/g, most preferably 5–60 $\mu$C/g. The method of measuring triboelectric charges referred to herein will be described hereinafter.

The developing method using the two-component type developer according to the present invention may for example be performed by using a developing means as shown in FIG. 1. It is preferred to effect a development in a state where a magnetic brush contacts a latent image-bearing member, e.g., a photosensitive drum 3 under application of an alternating electric field.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

A frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 1 with the photosensitive drum 3 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, it may become difficult to sufficiently prevent the carrier attachment. The developing nip C may be appropriately adjusted by changing a distance A between a developer regulating member 2 and the developing sleeve 1 and/or changing the gap B between the developing sleeve 1 and the photosensitive drum 3.

The image forming method according to the present invention may be particularly effectively used in formation of a full color image for which a halftone reproducibility is a great concern by using at least 3 developing devices for magenta, cyan and yellow, adopting the developers and developing method according to the present invention and preferably adopting a developing system for developing digital latent images in combination, whereby a development faithful to a dot latent image becomes possible while avoiding an adverse effect of the magnetic brush and disturbance of the latent image. The use of the toner having a sharp particle size distribution is also effective in realizing a high transfer ratio in a subsequent transfer step. As a result, it becomes possible to high image qualities both at the halftone portion and the solid image portion.

In addition to the high image quality at an initial stage of image formation, the use of the two-component type developer according to the present invention is also effective in avoiding the lowering in image quality in a continuous image formation on a large number of sheets because of a low shearing force acting on the developer in the developer vessel.

In order to provide full color images giving a clearer appearance, it is preferred to use four developing devices for magenta, cyan, yellow and black, respectively, and finally effect the black development.

An image forming apparatus suitable for practicing full-color image forming method according to the present invention will be described with reference to FIG. 3.

Figure 3:
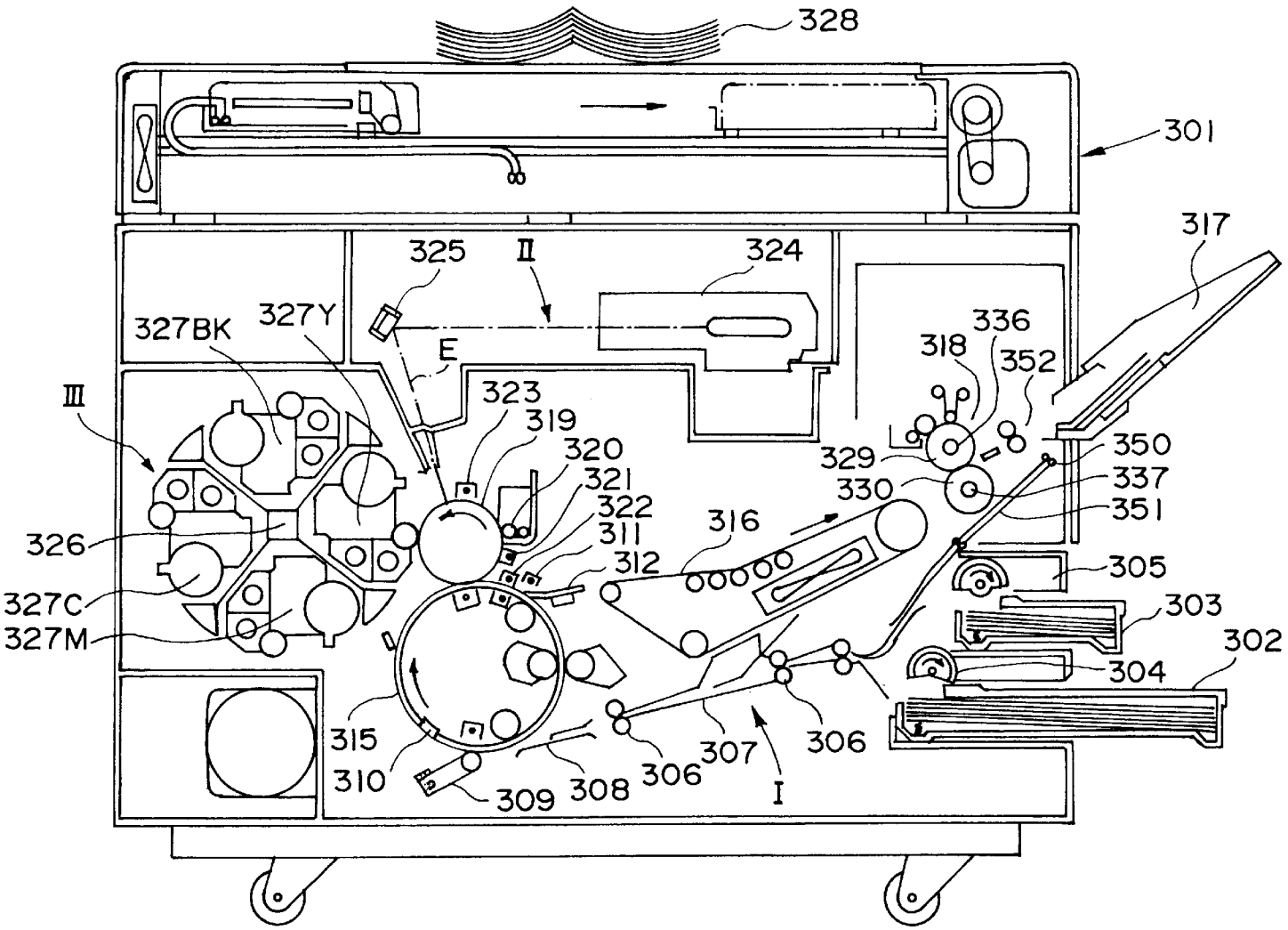
FIG. 3 is a schematic view of an apparatus for practicing an embodiment of the image forming method according to the present invention.

The color electrophotographic apparatus shown in FIG. 3 is roughly divided into a transfer material (recording sheet)-conveying section I including a transfer drum 315 and extending from the right side (the right side of FIG. 3) to almost the central part of an apparatus main assembly 301, a latent image-forming section II disposed close to the transfer drum 315, and a developing means (i.e., a rotary developing apparatus) III.

The transfer material-conveying section I is constituted as follows. In the right wall of the apparatus main assembly 301, an opening is formed through which are detachably disposed transfer material supply trays 302 and 303 so as to protrude a part thereof out of the assembly. Paper (transfer material)-supply rollers 304 and 305 are disposed almost right above the trays 302 and 303. In association with the paper-supply rollers 304 and 305 and the transfer drum 315 disposed leftward thereof so as to be rotatable in an arrow A direction, paper-supply rollers 306, a paper-supply guide 307 and a paper-supply guide 308 are disposed. Adjacent to the outer periphery of the transfer drum 315, an abutting roller 309, a gripper 310, a transfer material separation charger 311 and a separation claw 312 are disposed in this order from the upstream to the downstream along the rotation direction.

Inside the transfer drum 315, a transfer charger 313 and a transfer material separation charger 314 are disposed. A portion of the transfer drum 315 about which a transfer material is wound about is provided with a transfer sheet (not shown) attached thereto, and a transfer material is closely applied thereto electrostatically. On the right side above the transfer drum 315, a conveyer belt means 316 is disposed next to the separation claw 312, and at the end (right side) in transfer direction of the conveyer belt means 316, a fixing device 318 is disposed. Further downstream of the fixing device is disposed a discharge tray 317 which is disposed partly extending out of and detachably from the main assembly 301.

The latent image-forming section II is constituted as follows. A photosensitive drum (e.g., an OPC photosensitive drum) as a latent image-bearing member rotatable in an arrow direction shown in the figure is disposed with its peripheral surface in contact with the peripheral surface of the transfer drum 315. Generally above and in proximity with the photosensitive drum 319, there are sequentially disposed a discharging charger 320, a cleaning means 321 and a primary charger 323 from the upstream to the downstream in the rotation direction of the photosensitive drum 319. Further, an imagewise exposure means including, e.g., a laser 324 and a reflection means like a mirror 325, is disposed so as to form an electrostatic latent image on the outer peripheral surface of the photosensitive drum 319.

The rotary developing apparatus III is constituted as follows. At a position opposing the photosensitive drum 319, a rotatable housing (hereinafter called a "rotary member") 326 is disposed. In the rotary member 326, four-types of developing devices are disposed at equally distant four radial directions so as to visualize (i.e., develop) an electrostatic latent image formed on the outer peripheral surface of the photosensitive drum 319. The four-types of developing devices include a yellow developing device 327Y, a magenta developing device 327M, a cyan developing apparatus 327C and a black developing apparatus 327BK.

The entire operation sequence of the above-mentioned image forming apparatus will now be described based on a full color mode. As the photosensitive drum 319 is rotated in the arrow direction, the drum 319 is charged by the primary charger 323. In the apparatus shown in FIG. 3, the moving peripheral speeds (hereinafter called "process speed") of the respective members, particularly the photosensitive drum 319, may be at least 100 mm/sec, (e.g., 130–250 mm/sec). After the charging of the photosensitive drum 319 by the primary charger 323, the photosensitive drum 329 is exposed imagewise with laser light modulated with a yellow image signal from an original 328 to form a corresponding latent image on the photosensitive drum 319, which is then developed by the yellow developing device 327Y set in position by the rotation of the rotary member 326, to form a yellow toner image.

A transfer material (e.g., plain paper) sent via the paper supply guide 307, the paper supply roller 306 and the paper supply guide 308 is taken at a prescribed timing by the gripper 310 and is wound about the transfer drum 315 by means of the abutting roller 309 and an electrode disposed opposite the abutting roller 309. The transfer drum 315 is rotated in the arrow A direction in synchronism with the photosensitive drum 319 whereby the yellow toner image formed by the yellow-developing device is transferred onto the transfer material at a position where the peripheral surfaces of the photosensitive drum 319 and the transfer drum 315 abut each other under the action of the transfer charger 313. The transfer drum 315 is further rotated to be prepared for transfer of a next color (magenta in the case of FIG. 3).

On the other hand, the photosensitive drum 319 is charge-removed by the discharging charger 320, cleaned by a cleaning blade or cleaning means 321, again charged by the primary charger 323 and then exposed imagewise based on a subsequent magenta image signal, to form a corresponding electrostatic latent image. While the electrostatic latent image is formed on the photosensitive drum 319 by image-wise exposure based on the magenta signal, the rotary member 326 is rotated to set the magenta developing device 327M in a prescribed developing position to effect a development with a magenta toner. Subsequently, the above-mentioned process is repeated for the colors of cyan and black, respectively, to complete the transfer of four color toner images. Then, the four color-developed images on the transfer material are discharged (charge-removed) by the chargers 322 and 314, released from holding by the gripper 310, separated from the transfer drum 315 by the separation claw 312 and sent via the conveyer belt 316 to the fixing device 318, where the four-color toner images are fixed under heat and pressure. Thus, a series of full color print or image formation sequence is completed to provide a prescribed full color image on one surface of the transfer material.

Alternatively, the respective color toner images can be once transferred onto an intermediate transfer member and then transferred to a transfer material to be fixed thereon.

The fixing speed of the fixing device is slower (e.g., at 90 mm/sec) than the peripheral speed (e.g., 160 mm) of the photosensitive drum. This is in order to provide a sufficient heat quantity for melt-mixing yet un-fixed images of two to four toner layers. Thus, by performing the fixing at a slower speed than the developing, an increased heat quantity is supplied to the toner images.

Now, methods for measuring various properties referred to herein will be described.

1) Particle size of magnetic carrier

At least 300 particles (diameter of 0.1 $\mu$m or larger) are taken at random from a sample carrier by observation through an optical microscope at a magnification of 100–5000, and an image analyzer (e.g., "Luzex 3" available from Nireco K.K.) is used to measure the horizontal FERE diameter of each particle as a particle size, thereby obtaining a number-basis particle size distribution and a number-average particle size, from which the number-basis proportion of particles having sizes in the range of at most a half of the number-average particle size is calculated.

2) Magnetic properties of a magnetic carrier

Measured by using an oscillating magnetic field-type magnetic property automatic recording apparatus ("BHV-30", available from Riken Denshi K.K.). A magnetic carrier is placed in an external magnetic field of 10 kilo-oersted to measure a saturation magnification under this state. More specifically, a magnetic carrier powder sample is sufficiently tightly packed in a cylindrical plastic cell having a volume of ca. 0.07 $cm^3$ so as not to cause movement of carrier particles during the movement. In this state, a magnetic moment is measured and divided by an actual packed sample volume to obtain a magnetization (intensity of magnetization) per unit volume.

3) Measurement of (electrical) resistivity of magnetic carrier

Figure 2:
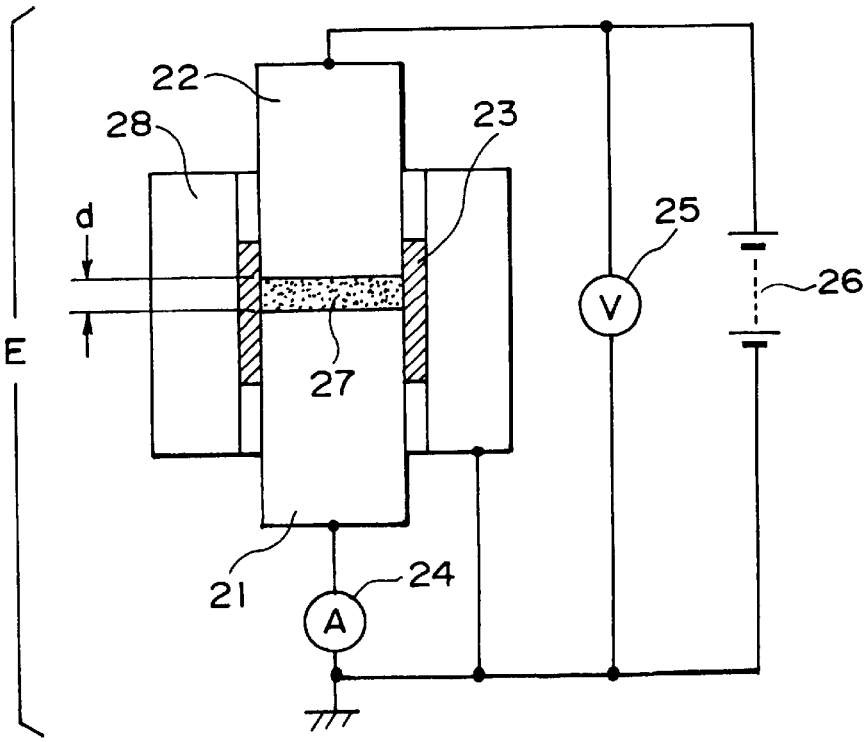
FIG. 2 is an illustration of an apparatus for measuring the (electrical) resistivity of a magnetic carrier, a carrier core and a metal oxide.

The resistivity of a carrier is measured by using an apparatus (cell) E as shown in FIG. 2 equipped with a lower electrode 21, an upper electrode 22, an insulator 23, an ammeter 24, a voltmeter 25, a constant-voltage regulator 26 and a guide ring 28. For measurement, the cell E is charged with ca. 1 g of a sample carrier 27, in contact with which the electrodes 21 and 22 are disposed to apply a voltage therebetween, whereby a current flowing at that time is measured to calculate a resistivity. As a magnetic carrier is in powder form so that care should be taken so as to avoid a change in resistivity due to a change in packing state. The resistivity values described herein are based on measurement under the conditions of the contact area between the carrier 27 and the electrode 21 or 12=ca. 2.3 $cm^2$, the carrier thickness=ca. 2 mm, the weight of the upper electrode 22=180 g, and the applied voltage=100 volts.

4) Particle size of magnetic iron compound and non-magnetic metal oxide

Photographs at a magnification of 5,000–20,000 of a sample metal oxide powder are taken through a transmission electron microscope ("H-800", available from Hitachi Seisakusho K.K.). At least 300 particles (diameter of 0.01 $\mu$m or larger) are taken at random in the photographs and subjected to analysis by an image analyzer ("Luzex 3", available from Nireco K.K.) to measure a horizontal FERE diameter of each particle as its particle size. From the measured values for the at least 300 sample particles, a number-average particle size is calculated.

5) Presence ratio between magnetic iron compound and non-magnetic metal oxide

The presence ratio between the magnetic iron compound and non-magnetic metal oxide inside the magnetic carrier particle and at the surface of the magnetic carrier particle or core particle may be measured in the following manner.

Carrier section samples may be prepared by dispersing carrier particles or carrier core particles within an epoxy resin, followed by fixation by solidification, and slicing the carrier-embedded resin samples by a microtome (e.g., "FC4E", available from REICHER-JUNG).

Arbitrary selected particle sections are observed and photographed at a magnification of 5,000 to 20,000 through a scanning electron microscope ("S-800", available from Hitachi Seisakusho K.K.), and the photographed particle sections were analyzed by an image analyzer ("Luzex 3" available from Nireco K.K.) to measure a horizontal FERE diameter D for each dispersed particle section. Assuming that the magnetic iron compound particles and non-magnetic metal oxides are spherical in shape, the volume of each dispersed particle is calculated to be $\pi D^3/6$. On each particle section, an inside region is defined as a region of from the center to the radius ×0.3, and a surface region is defined as a region of from the radius ×0.95 to the radius ×1.0. For each carrier (core) particle, the total volume per unit area ($\mu m^2$) of magnetic iron compound particles and non-magnetic metal oxide particles respectively appearing in the inside region of the particle section concerned are calculated and denoted by Pa1 and Pb1 respectively, and the total volumes per unit area ($\mu m^2$) of magnetic iron compound particles and non-magnetic metal oxide particles respectively appearing in the surface region are calculated and denoted by Pa2 and Pb2, respectively. The values Pa1, Pb1, Pa2 and Pb3 are averaged with respect to 20 carrier (core) particles for calculation of ratios Pa1/Pb1 and Pa2/Pb2.

6) Resistivity of magnetic iron compound and non-magnetic metal oxide

Measured similarly as the above-mentioned resistivity measurement for a carrier. A sample compound or metal oxide is placed between and so as to evenly contact the electrodes 21 and 22 in a cell shown in FIG. 2 and, under this state, a voltage is applied between the electrodes to measure a current passing therebetween as a result, from which a resistivity is calculated. In order to ensure the uniform contact of the sample with the electrodes, the sample is packed while reciprocally rotating the lower electrode 21. The values described herein are based on measurement under the conditions of the contact area between the packed metal oxide and the electrodes S=ca. 2.3 $cm^2$, the sample thickness d=ca. 2 mm, the weight of the upper electrode 22=180 g, and the applied voltage=100 volts.

7) Particle size of toner

Into 100–150 ml of an electrolyte solution (1%-NaCl aqueous solution), 0.1–5 ml of a surfactant (alkylbenzenesulfonic acid salt) is added, and 2–20 mg of a sample toner is added. The sample suspended in the electrolyte liquid is subjected to a dispersion treatment for 1–3 min. Then, the sample liquid is supplied to a Coulter counter ("Multisizer", available from Coulter Electronics Inc.) with an aperture size of, e.g., 17 $\mu$m or 100 $\mu$m to obtain a volume-basis particle size distribution in the range of 2–40 $\mu$m, from which a number-basis particle size distribution, a number-average particle size (D1) and a weight-average particle size (D4) are calculated by a personal computer.

8) Triboelectric charge

A toner and a magnetic carrier are weighed to provide a mixture containing 5 wt. % of the toner, and the mixture is subjected to mixing for 60 sec. by a Turbula mixer. The resultant powder mixture (developer) is placed in a metal container equipped with a 500-mesh electroconductive screen at the bottom, and the toner in the developer is selectively removed by sucking at a suction pressure of 250 mmHg through the screen by operating an aspirator. The triboelectric charge Q of the toner is calculated from a weight difference before and after the suction and a voltage resulted in a capacitor connected to the container based on the following equation:

$$Q(\mu C/g)=(C\times V)/(W_1-W_2),$$

wherein $W_1$ denotes the weight before the suction, $W_2$ denotes the weight after the suction, C denotes the capacitance of the capacitor, and V denotes the potential reading at the capacitor.

Hereinbelow, the present invention will be described based on Examples, wherein "parts" used for indicating the amount of components denotes "parts by weight".

EXAMPLE 1

| | |
|---|---|
| Phenol | 10 parts |
| Formalin (containing ca. 40 wt. % of formaldehyde, ca. 10 wt. % of methanol, and remainder of water) | 6 parts |
| Magnetite (magnetic iron compound, $d_{av}$ (average particle size) = 0.24 pm, Rs (resistivity) = $5\times10^5$ ohm.cm) | 31 parts |
| $\alpha$-$Fe_2O_3$ (hematite) (non-magnetic metal oxide, $d_{av}$ = 0.60 $\mu$m, Rs = $8\times10^9$ ohm.cm) | 53 parts |

The above materials, 4 parts of 28 wt. % ammonia water (basic catalyst) and 15 parts of water were placed in a flask and, under stirring for mixing, heated to 85° C. in 40 min., followed by holding at that temperature for 3 hours of curing reaction. Then, the content was cooled to 30° C., and 100 parts of water was added thereto, followed by removal of the supernatant and washing with water and drying in air of the precipitate. The dried precipitate was further dried at 50–60° C. at a reduced pressure of at most 5 mmHg, thereby to obtain spherical magnetic carrier core particles containing the magnetite and the hematite in a phenolic resin binder. The carrier core particles showed Rs=$8.0\times10^{12}$ ohm.cm.

The magnetic carrier core particles were surface-coated with a thermosetting silicone resin in the following manner. So as to provide a coating resin rate of 1.0 wt. %, a 10 wt. % carrier coating resin solution in toluene was prepared. Into the solution, the carrier core particles were added, and the resultant mixture was heated under the action of a shearing force to vaporize the solvent to provide a coating on the carrier core. The resultant coated magnetic carrier particles were subjected to curing for 1 hour at 250° C., followed by disintegration and sieving through a 100-mesh sieve, to obtain coated magnetic carrier particles, which showed a number-average particle size (D1) of 43 $\mu$m and a sphericity (SF1) of 1.04.

The coated magnetic carrier showed a resistivity (Rs) of $9\times10^{13}$ ohm.cm and a saturation magnetization $\sigma_s$ of 28 emu/g.

The properties of the coated magnetic carrier are inclusively shown in Table 1 appearing hereinafter.

On the other hand, toners were prepared in the following manner.

| Yellow toner | |
|---|---|
| Polyester resin (condensation product between bisphenol and fumaric acid) | 100 parts |
| C.I. Pigment Yellow (colorant) | 4.5 parts |
| Cr-complex salt of di-t-butyl-salicylic acid (negative charge control agent, pale) | 4 parts |

(negative charge control agent, pale)

The materials were sufficiently preliminarily blended, melt-kneaded, cooled and coarsely crushed by a hammer mill into particle sizes of ca. 1–2 mm. Then, the product was further pulverized by an air jet-type pulverizer. The pulverizate was classified by an Elbow Jet classifier to recover a negatively chargeable yellow powder (non-magnetic yellow toner).

100 wt. parts of the above yellow toner, and 0.8 wt. part of hydrophobized titanium oxide fine powder were blended with each other in a Henschel mixer to obtain a yellow toner carrying the titanium oxide fine powder externally added thereto. The yellow toner showed a weight-average particle size (D4) of 8.6 $\mu$m, a number-average particle size (D1) of 6.5 $\mu$m, and a ratio (D4/D1) of 1.32. The toner showed a triboelectric charge (TC) of −27.1 $\mu$C/g when measured together with the above-prepared coated magnetic carrier (at a toner concentration of 5 wt. %).

| Magenta toner | |
|---|---|
| Polyester resin (same as for yellow toner) | 100 parts |
| C.I. Pigment Red 122 | 4 parts |
| C.I. Basic Red 12 | 1 part |
| Cr-complex salt of di-t-butyl-salicylic acid | 4 parts |

From the above materials, a negatively chargeable magenta powder (non-magnetic magenta toner) was prepared in the same manner as the yellow toner.

100 wt. parts of the above magenta toner, and 8.0 wt. part of hydrophobized titanium oxide fine powder were blended with each other in a Henschel mixer to obtain a magenta toner carrying the titanium oxide fine powder externally added thereto. The magenta toner showed D4=8.4 μm, D1=6.5 μm, and D4/D1=1.29. The toner showed a triboelectric charge (TC) of −25.3 μC/g when measured together with the above-prepared coated magnetic carrier.

| Cyan toner | |
|---|---|
| Polyester resin (same as for yellow toner) | 100 parts |
| Copper-phthalocyanine pigment | 5 parts |
| Cr-complex salt of di-t-butyl-salicylic acid | 4 parts |

From the above materials, a negatively chargeable cyan powder (non-magnetic cyan toner) was prepared in the same manner as the yellow toner.

100 wt. parts of the above cyan toner, and 0.8 wt. part of hydrophobized titanium oxide fine powder were blended with each other in a Henschel mixer to obtain a cyan toner carrying the titanium oxide fine powder externally added thereto. The cyan toner showed D4=8.6 μm, D1=6.4 μm and D4/D1=1.34. The toner showed a triboelectric charge (TC) of −27.8 μC/g when measured together with the above-prepared coated magnetic carrier.

| Black toner | |
|---|---|
| Polyester resin (same as for yellow toner) | 100 parts |
| Carbon black (primary particle size = 60 nm) | 5 parts |
| Cr-complex salt of di-t-butyl-salicylic acid | 4 parts |

From the above materials, a negatively chargeable black powder (non-magnetic black toner) was prepared in the same manner as the yellow toner.

100 wt. parts of the above black toner, and 0.8 wt. part of hydrophobized titanium oxide fine powder were blended with each other in a Henschel mixer to obtain a black toner carrying the titanium oxide fine powder externally added thereto. The black toner showed D4=8.4 μm, D1=6.5 μm and D4/D1=1.29. The toner showed a triboelectric charge (TC) of −26.3 μC/g when measured together with the above-prepared coated magnetic carrier.

The above-prepared coated magnetic carrier was mixed with each of the above-prepared respective color toners to prepare four two-component type developers each having a toner concentration of 8.0 wt. %. The two-component type developers were charged in a full color laser copier ("CLC-500", mfd. by Canon K.K.) in a remodeled form so as to have developing devices each as shown in FIG. 1. Referring to FIG. 1, each developing device was designed to have a spacing A of 600 μm between a developer carrying member (developing sleeve) 1 and a developer-regulating member (magnetic blade) 2, and a gap B of 500 μm between the developing sleeve 1 and an electrostatic latent image-bearing member (photosensitive drum) 3. A developing nip C at that time was 5 mm. The developing sleeve 1 and the photosensitive drum 3 were driven at a peripheral speed ratio of 1.75:1. A developing sleeve S1 of the developing sleeve was designed to provide a magnetic field of 1 kilo-oersted, and the developing conditions included an alternating electric field of a rectangular waveform having a peak-to-peak voltage of 2000 volts and a frequency of 2000 Hz, a developing bias of −470 volts, a toner developing contrast (Vcont) of 325 volts, a fog removal voltage (Vback) of 100 volts, and a primary charge voltage on the photosensitive drum of −570 volts. Under the developing conditions, a digital latent image on the photosensitive drum 3 was developed by a reversal development mode.

As a result, the resultant images showed a high solid part image density (representatively as measured at a cyan toner image portion), were free from roughening of dots, and showed no image disorder or fog at the image or non-image portion due to carrier attachment.

A continuous full-color image formation was performed on a large number of 30,000 sheets. Thereafter, an imaging test was performed similarly as the initial stage. The solid image of cyan toner showed a high density, and the halftone showed a good reproducibility. Further, no fog or carrier attachment was observed. When the cyan developer after the continuous image formation was observed through a SEM (scanning electron microscope), the peeling of the coating resin on the carrier was not observed, but a good surface state similarly as that of the initial coated magnetic carrier surface.

The results are inclusively shown in Table 2 hereinafter.

EXAMPLE 2

| | |
|---|---|
| Phenol | 10 parts |
| Formalin (same as in Example 1) | 6 parts |
| Magnetite (same as in Example 1) | 44 parts |
| $\alpha$-$Fe_2O_3$ (same as in Example 1) | 44 parts |

The above materials were subjected to polymerization similarly as in Example 1 except for changing the amounts of the basic catalyst and water. The polymerizate particles were classified to obtain a magnetic-powder dispersed carrier core. The resultant carrier core showed a resistivity (Rs) of $5.2\times10^{12}$ ohm.cm.

The core particles were coated with a coating resin mixture of styrene-acrylate resin/fluorine-containing resin of 7/3 at a coating rate of 1.0 wt. % otherwise in a similar manner as in Example 1.

The coated magnetic carrier particles showed D1=55 μm and a sphericity (SF1) of 1.06.

The coated carrier particles showed Rs=$8.0\times10^{13}$ ohm.cm, and $\sigma_s$=39 emu/g.

The thus-obtained coated magnetic carrier was blended with the four color toners prepared in Example 1 to prepare four two-component type developers each having a toner concentration of 7 wt. %. The respective toners showed triboelectric charges of yellow: −30.2 μC/g, magenta: −28.7 μC/g, cyan: −32.9 μC/g and black: −29.8 μC/g, respectively, when measured at a toner concentration of 5 wt. %.

The developers were charged in the same image forming apparatus and used for development under the same developing conditions as in Example 1. As a result, similarly as in Example 1, images at the initial stage showed particularly excellent dot and thin-line reproducibility and high resolution, and were free from carrier attachment. As a result of a continuous full-color image formation on 30,000 sheets, the images thereafter showed almost similar image qualities as those at the initial stage. No carrier attachment was observed in the continuous image formation. The surface of the carrier after the continuous image formation was similarly good as that at the initial stage.

EXAMPLE 3

A magnetic carrier core was prepared through two-step polymerization by using the following materials.

| | |
|---|---|
| 1st step | |
| Phenol | 8 parts |
| Formalin (same as in Ex. 1) | 4.8 parts |
| Magnetite (same as in Ex. 1) | 75 parts |
| 2nd step | |
| Phenol | 2 parts |
| Formalin (same as in Ex. 1) | 1.2 parts |
| $\alpha$-$Fe_2O_3$ (same as in Ex. 1) | 9 parts |

Figure 4:
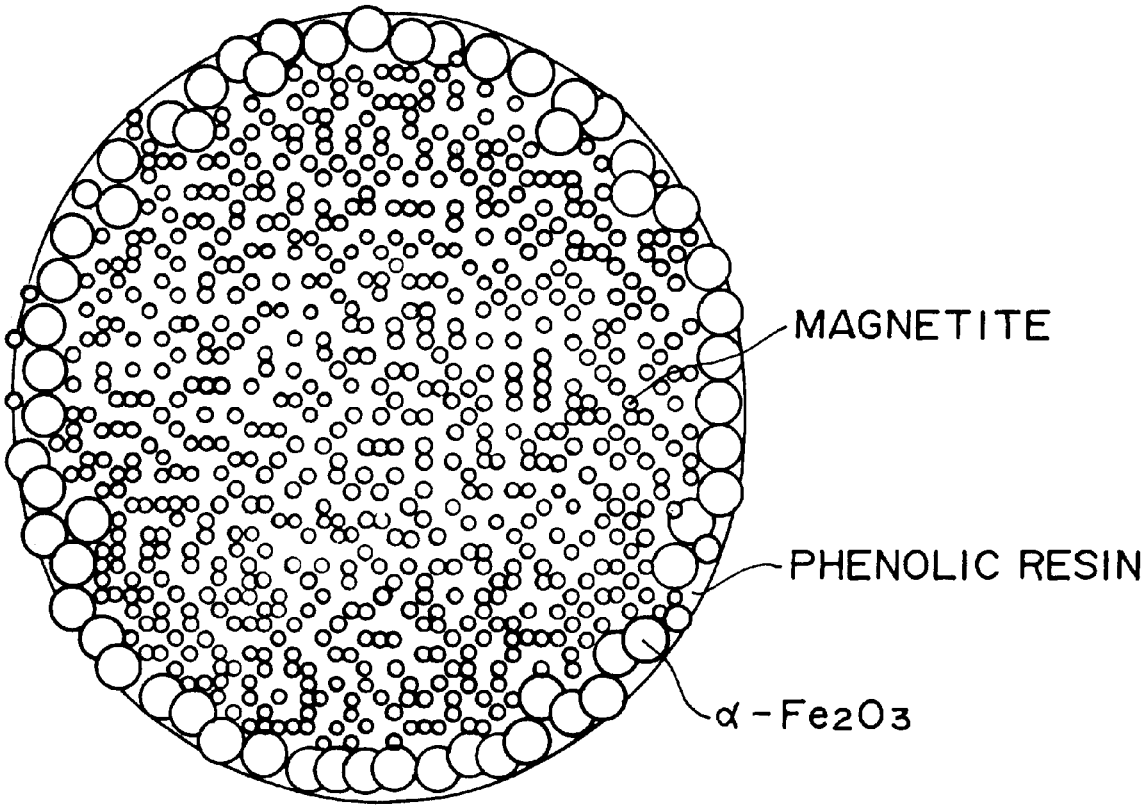
FIG. 4 is a sectional illustration of a magnetic carrier core particle according to an embodiment of the invention wherein non-magnetic metal oxide (hematite) particles are locally present at the core particle surface in preference to ferromagnetic metal oxide (magnetite) particles.

The first step polymerization was performed similarly as in Example 1 except for changing the amounts of the basic catalyst and water. Into the resultant slurry liquid, the above-mentioned materials for the second step was charged and subjected to similar suspension polymerization to obtain polymerizate particles. The polymerizate particles were classified to obtain magnetic powder-dispersed resin carrier core particles. The core particles showed Rs=$7.4\times10^{12}$ ohm.cm. As a result of observation through a scanning electron microscope, a core particle showed a section as schematically shown in FIG. 4 wherein the magnetite particles were present inside and larger $\alpha$-$Fe_2O_3$ particles were present at the surface. The core particles showed magnetic iron compound/non-magnetic metal oxide presence ratios of Pb1/Pa1=0 and Pb2/Pa2=19.3.

The core particles were coated with the same coating resin as in Example 1 but at a different coating rate of 1.3 wt. %.

The coated magnetic carrier particles showed D1=40 μm, and a sphericity (SF1) of 1.11.

The coated carrier particles showed Rs=$3.5\times10^{13}$ ohm.cm, and $\sigma_s$=68 emu/g.

The thus-obtained coated magnetic carrier was blended with the four color toners prepared in Example 1 to prepare four two-component type developers each having a toner concentration of 8 wt. %. The respective toners showed triboelectric charges of yellow: −25.1 μC/g, magenta: −24.3 μC/g, cyan: −27.7 μC/g and black: −23.0 μC/g.

The developers were charged in the same image forming apparatus and used for development under the same developing conditions as in Example 1 except for changing the spacing A between the developing sleeve 1 and the magnetic blade 2 to 800 μm. As a result, similarly as in Example 1, obtained images showed excellent dot reproducibility and high resolution, and were free from carrier attachment. As a result of a continuous full-color image formation on 30,000 sheets, the images thereafter showed almost similar image qualities as those at the initial stage. No carrier attachment was observed in the continuous image formation. The surface of the carrier after the continuous image formation was similarly good as that at the initial stage.

EXAMPLE 4

| | |
|---|---|
| Phenol | 6.5 parts |
| Formalin (same as in Example 1) | 3.5 parts |
| Magnetite (same as in Example 1) | 81 parts |
| $Al_2O_3$ ($d_{av}$ = 0.63 μm, Rs = $5\times10^{13}$ ohm.cm) | 9 parts |

The above materials were subjected to polymerization similarly as in Example 1. The polymerizate particles were classified to obtain a magnetic powder dispersed resin carrier core. The resultant carrier core showed Rs=$4.2\times10^{11}$ ohm.cm.

The core particles were coated with the same coating resin as in Example 1 but at a different coating rate of 2.0 wt. %.

The coated magnetic carrier particles showed D1=24 μm and a sphericity (SF1) of 1.09.

The coated carrier particles showed Rs=$7.2\times10^{13}$ ohm.cm, and $\sigma_s$=73 emu/g.

On the other hand, a toner was prepared in the following ingredients.

| Cyan toner | |
|---|---|
| Polyester resin (same as in Ex. 1) | 100 parts |
| Copper-phthalocyanine pigment | 6 parts |
| Cr-complex salt of di-t-butyl salicylic acid | 5 parts |

From the above ingredients, negatively chargeable cyan powder (cyan toner) was prepared in the same manner as in Example 1 except for changing the pulverization and classification conditions. One hundred parts of the cyan toner and 1.5 wt. parts of hydrophobized titanium oxide fine powder were blended with each other in a Henschel mixer to obtain a cyan toner carrying the titanium fine powder externally added thereto. The cyan toner showed D4=5.1 μm, D1=4.0 μm, D4/D1=1.27, and a triboelectric charge (TC) of −46.2 μC/g when measured with the above-prepared coated magnetic carrier.

The cyan toner was blended with the coated magnetic carrier at a toner concentration of 8 wt. % and subjected to mono-color-mode image formation in the same developing apparatus and under the same developing conditions as in Example 1. As a result, good images were obtained both at the initial stage and after continuous image formation on 30,000 sheets similarly as in Example 1. The carrier surface state after the continuous image formation was similar as that at the initial stage.

EXAMPLE 5

The carrier core prepared in Example 1 was used as a magnetic carrier without coating, and blended with the same four toners as in Example 1 to prepare four developers each having a concentration of 8 wt. %. The respective toners showed triboelectric charges of yellow: −38.4 μC/g, magenta: −35.7 μC/g, cyan: −39.4 μC/g and black: −36.6 μC/g.

The developers were charged in the same image forming apparatus and used for development under the same developing conditions as in Example 1. As a result, similarly as in Example 1, images at the initial stage showed high resolution, and were free from carrier attachment. As a result of a continuous full-color image formation on 30,000 sheets, the images thereafter showed almost similar image qualities as those at the initial stage. No carrier attachment was observed in the continuous image formation.

EXAMPLE 6

| | |
|---|---|
| Phenol | 6.5 parts |
| Formalin (same as in Example 1) | 3.5 parts |
| Magnetite (same as in Example 1) | 54 parts |
| $TiO_2$ | 36 parts |
| ($d_{av}$ = 0.70 $\mu$m, Rs = 3 × $10^{14}$ ohm.cm) | |

The above materials were subjected to polymerization similarly as in Example 1. The polymerizate particles were classified to form a magnetic powder dispersed resin carrier core. The resultant carrier core showed Rs=2.8×$10^{13}$ ohm.cm.

The core particles were coated with styrene/2-ethylhexyl methacrylate (50/50) copolymer otherwise similarly as in Example 1 to provide a coating rate of 1.2 wt. %.

The coated magnetic carrier particles showed D1=45 $\mu$m, and a sphericity (SF1) of 1.05.

The coated carrier particles showed Rs=9.8×$10^{13}$ ohm.cm, and $\sigma_s$=48 emu/$cm^3$.

The thus-obtained coated magnetic carrier was blended with the cyan toner prepared in Example 1 to prepare a developer. The toner showed a triboelectric charge of −27.2 $\mu$C/g.

The developer was charged in the same image forming apparatus and used for mono-color-mode development under the same developing conditions as in Example 1. As a result, good image qualities were obtained both at the initial stage and after 30,000 sheets of continuous image formation similarly as in Example 1. The carrier attachment prevention performance was good both before and after the continuous image formation. The carrier surfaces after the continuous image formation were good similarly as those at the initial stage.

Comparative Example 1

$Fe_2O_3$, CuO and ZnO were weighed so as to provide a composition of 50 mol. %, 27 mol. % and 23 mol. %, respectively, and were mixed with each other by a ball mill. The mixture was calcined at 1000° C., and pulverized by a ball mill. The resultant powder in 100 parts, 0.5 part of polysodium methacrylate and water were mixed with each other in a wet ball mill to form a slurry. The slurry was formed into particles by a spray drier. The particles were then sintered at 1200° C. to provide carrier core particles, which showed Rs=4.0×$10^8$ ohm.cm.

The carrier was surface-coated with a resin in the same manner as in Example 1. The resultant carrier particles showed D1=47 $\mu$m, Rs=1.1×$10^{10}$ ohm.cm, a sphericity (SF1)=1.24 and $\sigma_s$=62 emu/g.

The thus-obtained carrier was blended with the cyan color toner prepared in Example 1 to prepare developer. The cyan toner showed a triboelectric charge of −26.9 $\mu$C/g.

The developer was charged in the same image forming apparatus and used for monocolor-mode development under the same developing conditions as in Example 1. As a result, the resultant images showed a high solid part image density but were inferior with respect to roughening of dots and halftone reproducibility. Image disorder due to carrier attachment was not recognized at the image part or non-image part, but toner fog was recognized. Further, as a result of observation of the carrier after a continuous image formation in a similar manner as in Example 1, melt-sticking of toner was observed on the carrier. Images formed after the continuous image formation were accompanied with further inferior roughening of halftone part and further inferior fog.

Comparative Example 2

| | |
|---|---|
| Phenol | 10 parts |
| Formalin (same as in Example 1) | 6 parts |
| Magnetite | 31 parts |
| ($d_{av}$ = 0.61 $\mu$m, Rs = 5 × $10^5$ ohm.cm) | |
| $\alpha$-$Fe_2O_3$ | 53 parts |
| ($d_{av}$ = 0.60 $\mu$m, Rs = 8 × $10^9$ ohm.cm) | |

Polymerization of the above materials was performed similarly as in Example 1 except for changing the amounts of the basic catalyst and water. The resultant polymerizate particles were then classified to obtain a magnetic material-dispersed resinous carrier core. The resultant carrier core showed Rs=5.9×$10^8$ ohm.cm.

The core particles were coated similarly as in Example 1.

The coated magnetic carrier particles showed D1=45 $\mu$m and a sphericity (SF1) of 1.07.

The coated carrier particles showed Rs=1.0×$10^{11}$ ohm.cm, and $\sigma_s$=29 emu/g.

The thus-obtained coated magnetic carrier was blended with the cyan toner prepared in Example 1 to prepare a developer. The cyan toner showed a triboelectric charge of −28.8 $\mu$C/g.

The developer was charged in the same image forming apparatus and used for monocolor-mode development under the same developing conditions as in Example 1. As a result, halftone images at the initial stage were accompanied with roughening, and carrier attachment was recognized.

Comparative Example 3

| | |
|---|---|
| Phenol | 6.5 parts |
| Formalin (same as in Example 1) | 3.5 parts |
| Magnetite (same as in Example 1) | 45 parts |
| magnetite | 45 parts |
| ($d_{av}$ = 0.61 $\mu$m, Rs = 5 × $10^5$ ohm.cm) | |

From the above materials, polymerizate particles were obtained and then classified similarly as in Example 1 to obtain a magnetic material-dispersed resinous carrier core. The resultant carrier core showed Rs=7.5×$10^7$ ohm.cm.

The core particles were coated similarly as in Example 1.

The coated magnetic carrier particles showed D1=45 $\mu$m and a sphericity (SF1) of 1.06.

The coated carrier particles showed Rs=2.2×$10^{10}$ ohm.cm, and $\sigma_s$=73 emu/g.

The thus-obtained coated magnetic carrier was blended with the cyan toner prepared in Example 1 to prepare a developer. The cyan toner showed a triboelectric charge of −30.8 $\mu$C/g.

The developer was charged in the same image forming apparatus and used for development under the same developing conditions as in Example 3. As a result, the carrier attachment prevention was good, but halftone images were accompanied with some disorder of dot shape and recognizable roughening.

Comparative Example 4

The carrier was the same coated carrier as in Example 1. A cyan toner was prepared from the same composition and in the same manner as in Example 1 but under different pulverization and classification conditions.

The toner was blended with 0.5 wt. % of titanium oxide externally added thereto similarly as in Example 1. The resultant cyan toner showed D4=12.6 μm, D1=8.3 μm, D4/D1=1.52. The cyan toner showed a triboelectric charge of −20.1 μC/g when measured together with the above prepared magnetic carrier at a toner concentration of 5 wt. %. The cyan toner was blended with the above coated magnetic carrier to prepare a developer.

The developer was charged in the same image forming apparatus and used for monocolor-mode development under the same developing conditions as in Example 1. As a result, high image density was obtained but halftone images showed somewhat inferior dot reproducibility and were accompanied with roughening.

EXAMPLE 7

100 wt. parts of the carrier core prepared in Example 1 was blended with a coating liquid containing 2 parts of thermosetting phenolic resin and 6 parts of $\alpha$-$Fe_2O_3$ (same as used in Example 1) at a concentration of 10% in toluene, and the solvent was evaporated under the application of a shearing force to effect the coating. Further, the resin was cured at 160° C. under the application of a shearing force to form coated magnetic carrier particles. The coated carrier particles were then disintegrated and classified. The resultant coated magnetic carrier showed D1=45 μm, SF1=1.06, Rs=$1.0\times10^{13}$ ohm.cm, and magnetic iron compound/non-magnetic metal oxide presence ratios Pb1/Pa1=0, Pb2/Pa2=27.6.

The thus-obtained coated magnetic carrier was blended with the four-color toners prepared in Example 1 to prepare four two-component type developers each having a toner concentration of 8.0 wt. %. The respective toners showed triboelectric charges of yellow: −25.5 μC/g, magenta: −25.1 μC/g, cyan: −25.9 μC/g, and black: −24.3 μC/g.

The developers were charged in the same image forming apparatus and used for development under the same developing conditions. As a result, images having an excellent halftone reproducibility and a high image density were obtained. Particularly, the triboelectric charges of the toner during the continuous image formation were stable.

EXAMPLE 8

The coated magnetic carrier prepared in Example 7 was further coated with the same silicone resin as used in Example 1 in a similar manner as in Example 1. The resultant coated magnetic carrier showed D1=45 μm, SF1=1.05, Rs=$9.8\times10^{13}$ ohm.cm, and magnetic iron compound/non-magnetic metal oxide presence ratios Pb1/Pa1=0, Pb2/Pa2=29.3.

The thus-obtained coated magnetic carrier was blended with the four-color toners prepared in Example 1 to prepare four two-component type developers each having a toner concentration of 8.0 wt. %. The respective toners showed triboelectric charges of yellow: −23.0 μC/g, magenta: −22.5 μC/g, cyan: −24.4 μC/g, and black: −23.2 μC/g.

The developers were charged in the same image forming apparatus and used for development under the same developing conditions. As a result, images having an excellent halftone reproducibility and a high image density were obtained. Particularly, the developers showed a broad latitude of Vback for preventing fog and carrier attachment, and excellent stabilities.

EXAMPLE 9

A magnetic carrier core was prepared through two-step polymerization by using the following materials.

| | |
|---|---|
| 1st step | |
| Phenol | 7.5 parts |
| Formalin (same as in Ex. 1) | 4.5 parts |
| Magnetite (same as in Ex. 1) | 70 parts |
| 2nd step | |
| Phenol | 2.5 parts |
| Formalin (same as in Ex. 1) | 1.5 parts |
| Magnetite (same as in Ex. 1) | 5 parts |
| $\alpha$-$Fe_2O_3$ (same as in Ex. 1) | 9 parts |

The core particles obtained similarly as in Example 3 showed Rs=$3.3\times10^{12}$ ohm.cm and magnetic iron compound/non-magnetic metal oxide presence ratios of Pb1/Pa1=0 and Pb2/Pa2=4.58.

The core particles were coated similarly as in Example 1.

The coated magnetic carrier particles showed D1=40 μm, and a sphericity (SF1) of 1.10.

The coated carrier particles showed Rs=$3.2\times10^{13}$ ohm.cm, and $\sigma_s$=67 emu/g.

The thus-obtained coated magnetic carrier was blended with the four color toners prepared in Example 1 to prepare four two-component type developers each having a toner concentration of 8%. The respective toners showed triboelectric charges of yellow: −25.6 μC/g, magenta: −25.0 μC/g, cyan: −26.2 μC/g and black: −24.9 μC/g.

The developers were charged in the same image forming apparatus and used for development under the same developing conditions as in Example 1. As a result, similarly as in Example 1, obtained images showed excellent halftone reproducibility and high image densities. Further, the images were free from image disorder image part and non-image part due to carrier attachment and also from toner fog. As a result of a continuous full-color image formation on 30,000 sheets, the resultant images were free from toner scattering, showed a high solid part image density, and good reproducibility of halftone and line images. No carrier attachment was observed in the continuous image formation. As a result of observation of the cyan developer through a SEM after the continuous image formation, no peeling of the coating was observed, and the surface state was similarly good as that of the carrier at the initial stage.

EXAMPLE 10

The polymerizate particles prepared in Example 9 was further subjected to coating with the polymerization of the following ingredients.

| | |
|---|---|
| Phenol | 2 parts |
| Formalin (same as in Ex. 1) | 1.2 parts |
| $\alpha$-$Fe_2O_3$ (same as in Ex. 1) | 10 parts |

The suspension polymerization was performed in the same manner as in Example 3 to obtain a spherical carrier core. The resultant carrier core showed Rs=$9.3\times10^{12}$ ohm.cm, and magnetic iron compound/non-magnetic presence ratio of Pb1/Pa1=0 and Pb2/Pa2=32.3.

The core particles were coated with the same coating resin as in Example 2 but at a different coating rate of 1.0 wt. %.

The coated magnetic carrier particles showed D1=42 μm, and a sphericity (SF1) of 1.11.

The coated carrier particles showed Rs=$1.1\times10^{14}$ ohm.cm, and $\sigma_s$=60 emu/g.

The thus-obtained coated magnetic carrier was blended with the four color toners prepared in Example 1 to prepare four two-component type developers each having a toner concentration of 8 wt. %. The respective toners showed triboelectric charges of yellow: −32.3 μC/g, magenta: −29.9 μC/g, cyan: −32.4 μC/g and black: −30.3 μC/g.

The developers were charged in the same image forming apparatus and used for development under the same developing conditions as in Example 1. As a result, similarly as in Example 1, images obtained at the initial stage showed particularly good dot and thin-line reproducibilities and high resolution. Further, no toner scattering, fog or carrier attachment was observed. As a result of continuous full-color image formation on 30,000 sheets, the images thereafter showed almost similar image qualities as those at the initial stage. No toner scattering, fog or carrier attachment was observed in the continuous image formation. The surface of the carrier after the continuous image formation was similarly good as that at the initial stage.

The above-mentioned characteristic properties of carriers are summarized in Table 1 below, and the results of evaluation are summarized in Table 2 appearing hereinafter, for which the evaluation standards are inclusively shown after Table 2.

TABLE 2-continued

| Ex. or Comp.Ex. | Nip C (mm) | Solid cyan I.D. | Halftone roughening | Carrier attachment | Fog |
|---|---|---|---|---|---|
| 2 | 5 | 1.55 | Δx | x | ○ |
| 3 | 5.5 | 1.6 | Δx | ○ | Δ |
| 4 | 5 | 1.71 | Δx | ○ | ○ |
| Ex. 7 | 5 | 1.61 | ◎ | ○ | ○ |
| 8 | 5 | 1.65 | ◎ | ○ | ◎ |
| 9 | 6.5 | 1.65 | ◎ | ◎ | ○ |
| 10 | 6.5 | 1.66 | ◎ | ◎ | ◎ |

◎: excellent,
○: good,
Δ: fair,
Δx: somewhat inferior,
x: poor

[Notes to Table 2]

Solid cyan I.D.

The image density of a solid cyan image portion was measured by a Macbeth densitometer ("RD-918 Type" using SPI filter, mfd. by Macbeth Co.), as a relative density of an image printed on a sheet of plain paper.

Halftone roughening

The degree of roughening of halftone image portion was evaluated with eyes with reference to an original image and standard samples.

Carrier attachment

After formation of solid white image, a transparent adhesive tape was applied onto a region of 5 cm×5 cm between the developing region and the cleaner region on the photosensitive drum to recover magnetic carrier particles attached to the photosensitive drum. The number of attached carrier particles attached in the region of 5 cm×5 cm was counted, and evaluation was performed based on the number of attached carrier particles per $cm^2$ calculated therefrom according to the following standard:

◎ (excellent): less than 10 particles/$cm^2$
○ (good): 10 to less than 20 particles/$cm^2$
Δ (fair): 20 to less than 50 particles/$cm^2$
Δx (somewhat inferior): 50 to less than 10 particles/$cm^2$
x (poor): 100 particles/$cm^2$ or more Fog The average reflection rate Dr (%) of the sheet of plain paper before printing was measured by a reflectometer

TABLE 1

| | Core | | | | | | | | | Carrier | | | |
|---|---|---|---|---|---|---|---|---|---|---|---|---|---|
| | Magnetic iron compound | | | Non-magnetic metal oxide | | | | Binder* | | | | | |
| | | $r_a$ (D1) (μm) | Amount (wt. %) | | $r_b$ (D1) (μm) | Amount (wt.%) | $r_b/r_a$ | content (wt %) | Rs (ohm.cm) | Rs (ohm.cm) | $o_s$ (emu/g) | D1 (μm) | $d_B$** (g/$cm^3$) |
| Ex. 1 | magnetite | 0.24 | 31 | α-$Fe_2O_3$ | 0.6 | 53 | 2.5 | 16 | $8.0\times10^{12}$ | $9.0\times10^{13}$ | 28 | 43 | 1.85 |
| 2 | magnetite | 0.24 | 44 | α-$Fe_2O_3$ | 0.4 | 44 | 1.7 | 16 | $5.2\times10^{12}$ | $8.0\times10^{13}$ | 39 | 55 | 1.88 |
| 3 | magnetite | 0.24 | 75 | α-$Fe_2O_3$ | 0.6 | 9 | 2.5 | 16 | $7.4\times10^{12}$ | $3.5\times10^{13}$ | 68 | 40 | 1.86 |
| 4 | magnetite | 0.24 | 81 | alumina | 0.63 | 9 | 2.6 | 10 | $4.2\times10^{11}$ | $7.2\times10^{13}$ | 71 | 24 | 1.9 |
| 5 | magnetite | 0.24 | 31 | α-$Fe_2O_3$ | 0.6 | 53 | 2.5 | 16 | $8.0\times10^{12}$ | $8.0\times10^{12}$ | 28 | 43 | 1.85 |
| 6 | magnetite | 0.24 | 54 | $TiO_2$ | 0.7 | 36 | 2.9 | 10 | $2.8\times10^{13}$ | $9.8\times10^{13}$ | 48 | 45 | 1.91 |
| Comp.Ex. 1 | CuZn ferrite | | 100 | — | | — | — | — | $4.0\times10^{8}$ | $1.1\times10^{10}$ | 62 | 47 | 2.35 |
| 2 | magnetite | 0.61 | 31 | α-$Fe_2O_3$ | 0.4 | 53 | 0.66 | 16 | $5.9\times10^{8}$ | $1.0\times10^{11}$ | 29 | 45 | 1.85 |
| 3 | magnetite | 0.24 | 45 | magnetite | 0.61 | 45 | 2.5 | 10 | $7.5\times10^{8}$ | $2.2\times10^{10}$ | 73 | 45 | 1.84 |
| Ex. 7 | magnetite | 0.24 | 31 | α-$Fe_2O_3$ | 0.6 | 53 | 2.5 | 16 | $8.0\times10^{12}$ | $1.0\times10^{13}$ | 26 | 45 | 1.89 |
| 8 | magnetite | 0.24 | 31 | α-$Fe_2O_3$ | 0.6 | 53 | 2.5 | 16 | $8.0\times10^{12}$ | $9.8\times10^{13}$ | 25 | 45 | 1.87 |
| 9 | magnetite | 0.24 | 75 | α-$Fe_2O_3$ | 0.6 | 9 | 2.5 | 16 | $3.3\times10^{12}$ | $3.2\times10^{13}$ | 67 | 40 | 1.87 |
| 10 | magnetite | 0.24 | 66.2 | α-$Fe_2O_3$ | 0.6 | 16.8 | 2.5 | 17 | $9.3\times10^{12}$ | $1.1\times10^{14}$ | 60 | 42 | 1.92 |

*: The binder used was phenolic resin unless otherwise noted specifically.
**: $d_B$ represents a bulk density.

TABLE 2

| Ex. or Comp.Ex. | Nip C (mm) | Solid cyan I.D. | Halftone roughening | Carrier attachment | Fog |
|---|---|---|---|---|---|
| Ex. 1 | 5 | 1.63 | ◎ | ○ | ◎ |
| 2 | 5 | 1.61 | ◎ | ○ | ○ |
| 3 | 6.5 | 1.69 | ◎ | ◎ | ○ |
| 4 | 6 | 1.68 | ◎ | ○ | ◎ |
| 5 | 5 | 1.59 | ○ | ○ | ○ |
| 6 | 5.5 | 1.62 | ◎ | ○ | ◎ |
| Comp. Ex. 1 | 6.5 | 1.58 | x | ○ | x |

("REFLECTOMETER MODEL TC-6DS" mfd. by Tokyo Denshoku K.K.). On the other hand, a solid white image was printed onto the sheet of plain paper, and the reflection rate Ds (%) of the solid white image was measured by the reflectometer. Fog (%) was calculated by the following equation:

$$Fog(\%)=Dr(\%)-Ds(\%)$$

The evaluation was performed according to the following standard:

◎ (excellent): below 1.0%,

○ (good): 1.0 - below 1.5%,

Δ (fair): 1.5 - below 2.0%,

Δx (somewhat inferior): 2.0 - below 3.0%, x (poor): 3% or more.

What is claimed is:

1. A two-component developer for developing an electrostatic image, comprising: at least a toner and a magnetic carrier; wherein the toner has a weight-average particle size D4 of at most 10 μm and a number-average particle size D1 satisfying D4/D1≦1.5; and the magnetic carrier has an electrical resistivity of at least $1\times10^{12}$ ohm.cm at an electric field intensity of $5\times10^{4}$ volts/meter, and comprises composite particles comprising a mixture of magnetic iron compound particles, non-magnetic metal oxide particles, and a binder comprising a phenolic resin; the composite particles containing the magnetic iron compound and the non-magnetic metal oxide in a total proportion of 80–99 wt. %; the magnetic iron compound particles having a number-average particle size $r_a$, the non-magnetic metal oxide particles having (i) a number-average particle size $r_b$ satisfying $r_b/r_a$ >1.0 and (ii) a higher resistivity than the magnetic iron compound particles, each of the composite particles containing the non-magnetic metal oxide particles and the magnetic iron compound particles at and below the surface of the composite particle.

2. The developer according to claim 1, wherein the magnetic iron compound particles have a number-average particle size $r_a$ of 0.02–5 μm, and the non-magnetic metal oxide particles have a number-average particle size $r_b$ of 0.05–10 μm.

3. The developer according to claim 1 or 2, wherein the non-magnetic metal oxide particles are contained in an amount of 5–70 wt. % of the total of the magnetic iron compound particles and the non-magnetic metal oxide particles, and the magnetic carrier has a bulk density of 1.0–2.0 g/cm$^3$.

4. The developer according to claim 1 wherein the magnetic carrier is surface-coated with a resin containing the non-magnetic metal oxide particles.

5. The developer according to claim 1 or 4, wherein the magnetic carrier is surface-coated with 0.1–10 wt. % of a resin.

6. The developer according to claim 1, wherein the magnetic carrier has a saturation magnetization $\sigma_s$ of 10–80 emu/g.

7. The developer according to claim 1, wherein the magnetic iron compound comprises magnetite and the non-magnetic metal oxide comprises hematite.

8. The developer according to claim 1, wherein the toner is a non-magnetic toner.

9. The developer according to claim 1, wherein the magnetic carrier contains the magnetic iron compound particles and the non-magnetic metal oxide particles in such a distribution that a total volume Pa1 of magnetic iron compound particles and a total volume Pb1 of non-magnetic metal oxide particles respectively appearing in an inside part of a carrier core particle section, and a total volume Pa2 of magnetic iron compound particles and a total volume Pb2 of non-magnetic metal oxide particles respectively appearing at a surface part of the carrier core particle section are set to satisfy Pb1/Pa1<1 and Pb2/Pa2>1, so as to provide a higher resistivity to the surface part of the carrier particle than at the inside part of the carrier particle, wherein said carrier core is coated with a coating material.

10. The developer according to claim 1, wherein the magnetic carrier comprises a carrier core coated with 0.5–10 wt. % of a coating material.

11. The developer according to claim 10, wherein the magnetic carrier comprises a carrier core coated with 0.6–5 wt. % of a coating material.

12. The developer according to claim 1, wherein the magnetic carrier has a sphericity of at most 2.

13. The developer according to claim 1, wherein the magnetic carrier contains the magnetic iron compound particles and the non-magnetic metal oxide particles in such a distribution that a total volume Pa1 of magnetic iron compound particles and a total volume Pb1 of non-magnetic metal oxide particles respectively appearing in an inside part of a carrier particle section, and a total volume Pa2 of magnetic iron compound particles and a total volume Pb2 of non-magnetic metal oxide particles respectively appearing at a surface part of the carrier particle section are set to satisfy Pb1/Pa1<1 and Pb2/Pa2>1, so as to provide a higher resistivity to the surface part of the carrier particle than at the inside part of the carrier particle.

14. A developing method for developing an electrostatic image, comprising:

carrying a two-component developer by a developer-carrying member enclosing therein a magnetic field generating means, said two-component developer comprising a toner and a magnetic carrier; wherein the toner has a weight-average particle size D4 of at most 10 μm and a number-average particle size D1 satisfying D4/D1≦1.5; and the magnetic carrier has an electrical resistivity of at least $1\times10^{12}$ ohm.cm at an electric field intensity of $5\times10^{4}$ volts/meter, and comprises composite particles comprising a mixture of magnetic iron compound particles, non-magnetic metal oxide particles, and a binder comprising a phenolic resin; the composite particles containing the magnetic iron compound and the non-magnetic metal oxide in a total proportion of 80–99 wt. %; the magnetic iron compound particles having a number-average particle size ra, the non-magnetic metal oxide particles having (i) a number-average particle size rb satisfying rb/ra>1.0 and (ii) a higher resistivity than the magnetic iron compound particles each of the composite particles containing the non-magnetic metal oxide particles and the magnetic iron compound particles at and below the surface of the composite particle, forming a magnetic brush of the two-component developer on the developer-carrying member, causing the magnetic brush to contact a latent image-bearing member, and developing an electrostatic image on the latent image-bearing member to form a toner image while applying an alternating electric field to the developer-carrying member.

15. The developing method according to claim 14, wherein the electrostatic image comprises a digital image.

16. The developing method according to claim 14 or 15, wherein the electrostatic image is developed by a reversal development mode.

17. The developing method according to claim 14, wherein the magnetic iron compound particles have a number-average particle size $r_a$ of 0.02–5 μm, and the non-magnetic metal oxide particles have a number-average particle size $r_b$ of 0.05–10 μm.

18. The developing method according to claim 14 or 17, wherein the non-magnetic metal oxide particles are contained in an amount of 5–70 wt. % of the total of the magnetic iron compound particles and the non-magnetic metal oxide particles, and the magnetic carrier has a bulk density of 1.0–2.0 g/cm$^3$.

19. The developing method according to claim 14, wherein the magnetic carrier is surface-coated with a resin containing the non-magnetic metal oxide particles.

20. The developing method according to claim 14, wherein the magnetic carrier is surface-coated with 0.1–10 wt. % of a resin.

21. The developing method according to claim 14, wherein the magnetic carrier has a saturation magnetization $\sigma_s$ of 10–80 emu/g.

22. The developing method according to claim 14, wherein the magnetic iron compound comprises magnetite and the non-magnetic metal oxide comprises hematite.

23. The developing method according to claim 14, wherein the toner is a non-magnetic toner.

24. The developing method according to claim 14, wherein the magnetic carrier contains the magnetic iron compound particles and the non-magnetic metal oxide particles in such a distribution that a total volume Pa1 of magnetic iron compound particles and a total volume Pb1 of non-magnetic metal oxide particles respectively appearing in an inside part of a carrier core particle section, and a total volume Pa2 of magnetic iron compound particles and a total volume Pb2 of non-magnetic metal oxide particles respectively appearing at a surface part of the carrier core particle section are set to satisfy Pb1/Pa1<1 and Pb2/Pa2>1, so as to provide a higher resistivity to the surface part of the carrier particle than at the inside part of the carrier particle, wherein said carrier core is coated with a coating material.

25. The developing method according to claim 14, wherein the magnetic carrier comprises a carrier core coated with 0.5–10 wt. % of a coating material.

26. The developing method according to claim 25, wherein the magnetic carrier comprises a carrier core coated with 0.6–5 wt. % of a coating material.

27. The developing method according to claim 14, wherein the magnetic carrier has a sphericity of at most 2.

28. The developing method according to claim 14, wherein the magnetic carrier contains the magnetic iron compound particles and the non-magnetic metal oxide particles in such a distribution that a total volume Pa1 of magnetic iron compound particles and a total volume Pb1 of non-magnetic metal oxide particles respectively appearing in an inside part of a carrier particle section, and a total volume Pa2 of magnetic iron compound particles and a total volume Pb2 of non-magnetic metal oxide particles respectively appearing at a surface part of the carrier particle section are set to satisfy Pb1/Pa1<1 and Pb2/Pa2>1, so as to provide a higher resistivity to the surface part of the carrier particle than at the inside part of the carrier particle.

29. An image forming method, comprising:

(I) carrying a two-component developer by a developer-carrying member enclosing therein a magnetic field generating means, said two-component developer comprising a magenta toner and a magnetic carrier; wherein the magenta toner has a weight-average particle size D4 of at most 10 μm and a number-average particle size D1 satisfying D4/D1≦1.5; and the magnetic carrier has an electrical resistivity of at least $1\times10^{12}$ ohm.cm at an electric field intensity of $5\times10^4$ volts/meter, and comprises composite particles comprising a mixture of magnetic iron compound particles, non-magnetic metal oxide particles, and a binder comprising a phenolic resin; the composite particles containing the magnetic iron compound and the non-magnetic metal oxide in a total proportion of 80–99 wt. %; the magnetic iron compound particles having a number-average particle size ra, the non-magnetic metal oxide particles having (i) a number-average particle size $r_b$ satisfying $r_b/r_a>1.0$ and (ii) a higher resistivity than the magnetic iron compound particles, each of the composite particles containing the non-magnetic metal oxide particles and the magnetic iron compound particles at and below the surface of the composite particle, forming a magnetic brush of the two-component developer on the developer-carrying member, causing the magnetic brush to contact a latent image-bearing member, and developing an electrostatic image on the latent image-bearing member to form a magenta toner image while applying an alternating electric field to the developer-carrying member;

(II) carrying a two-component developer by a developer-carrying member enclosing therein a magnetic field generating means, said two-component developer comprising a cyan toner and a magnetic carrier: wherein the cyan toner has a weight-average particle size D4 of at most 10 μm and a number-average particle size D1 satisfying D4/D1≦1.5; and the magnetic carrier has an electrical resistivity of at least $1\times10^{12}$ ohm.cm at an electric field intensity of $5\times10^4$ volts/meter, and comprises composite particles comprising a mixture of magnetic iron compound particles, non-magnetic metal oxide particles, and a binder comprising a phenolic resin; the composite particles containing the magnetic iron compound and the non-magnetic metal oxide in a total proportion of 80–99 wt. %; the magnetic iron compound particles having a number-average particle size ra, the non-magnetic metal oxide particles having (i) a number-average particle size rb satisfying rb/ra>1.0 and (ii) a higher resistivity than the magnetic iron compound particles, each of the composite particles containing the non-magnetic metal oxide particles and the magnetic iron compound particles at and below the surface of the composite particle, forming a magnetic brush of the two-component developer on the developer-carrying member, causing the magnetic brush to contact a latent image-bearing member, and developing an electrostatic image on the latent image-bearing member to form a cyan toner image while applying an alternating electric field to the developer-carrying member;

(III) carrying a two-component developer by a developer-carrying member enclosing therein a magnetic field generating means, said two-component developer comprising a yellow toner and a magnetic carrier; wherein the yellow toner has a weight-average particle size D4 of at most 10 μm and a number-average particle size D1 satisfying D4/D1≦1.5; and the magnetic carrier has an electrical resistivity of at least $1\times10^{12}$ ohm.cm at an electric field intensity of $5\times10^{4}$ volts/meter, and comprises composite particles comprising a mixture of magnetic iron compound particles, non-magnetic metal oxide particles, and a binder comprising a phenolic resin; the composite particles containing the magnetic iron compound and the non-magnetic metal oxide in a total proportion of 80–99 wt. %; the magnetic iron compound particles having a number-average particle size ra, the non-magnetic metal oxide particles having (i) a number-average particle size rb satisfying rb/ra>1.0 and (ii) a higher resistivity than the magnetic iron compound particles, each of the composite particles containing the non-magnetic metal oxide particles and the magnetic iron compound particles at and below the surface of the composite particle, forming a magnetic brush of the two-component developer on the developer-carrying member, causing the magnetic brush to contact a latent image-bearing member, and developing an electrostatic image on the latent image-bearing member to form a yellow toner image while applying an alternating electric field to the developer-carrying member; and (IV) forming a full color image with at least the above-formed magenta toner image, cyan toner image and yellow toner image.

30. The image forming method according to claim 29, wherein the electrostatic image comprises a digital image.

31. The image forming method according to claim 29 or 30, wherein the electrostatic image is developed by a reversal development mode.

32. The image forming method according to claim 29, wherein the magnetic iron compound particles have a number-average particle size $r_a$ of 0.02–5 $\mu$m, and the non-magnetic metal oxide particles have a number-average particle size $r_b$ of 0.05–10 $\mu$m.

33. The image forming method according to claim 29, wherein the non-magnetic metal oxide particles are contained in an amount of 5–70 wt. % of the total of the magnetic iron compound particles and the non-magnetic metal oxide particles, and the magnetic carrier has a bulk density of 1.0–2.0 g/cm$^3$.

34. The image forming method according to claim 29, wherein the magnetic carrier is surface-coated with a resin containing the non-magnetic metal oxide particles.

35. The image forming method according to claim 29, wherein the magnetic carrier is surface-coated with 0.1–10 wt. % of a resin.

36. The image forming method according to claim 29, wherein the magnetic carrier has a saturation magnetization $\sigma_s$ of 10–80 emu/g.

37. The image forming method according to claim 29, wherein the magnetic iron compound comprises magnetite and the non-magnetic metal oxide comprises hematite.

38. The image forming method according to claim 29, wherein the toner is a non-magnetic toner.

39. The image forming method according to claim 29, wherein the magnetic carrier contains the magnetic iron compound particles and the non-magnetic metal oxide particles in such a distribution that a total volume Pa1 of magnetic iron compound particles and a total volume Pb1 of non-magnetic metal oxide particles respectively appearing in an inside part of a carrier core particle section, and a total volume Pa2 of magnetic iron compound particles and a total volume Pb2 of non-magnetic metal oxide particles respectively appearing at a surface part of the carrier core particle section are set to satisfy Pb1/Pa1<1 and Pb2/Pa2>1, so as to provide a higher resistivity to the surface part of the carrier particle than at the inside part of the carrier particle, wherein said carrier core is coated with a coating material.

40. The image forming method according to claim 29, wherein the magnetic carrier comprises a carrier core coated with 0.5–10 wt. % of a coating material.

41. The image forming method according to claim 40, wherein the magnetic carrier comprises a carrier core coated with 0.6–5 wt. % of a coating material.

42. The image forming method according to claim 29, wherein the magnetic carrier has a sphericity of at most 2.

43. The image forming method according to claim 29, wherein the magnetic carrier contains the magnetic iron compound particles and the non-magnetic metal oxide particles in such a distribution that a total volume Pa1 of magnetic iron compound particles and a total volume Pb1 of non-magnetic metal oxide particles respectively appearing in an inside part of a carrier particle section, and a total volume Pa2 of magnetic iron compound particles and a total volume Pb2 of non-magnetic metal oxide particles respectively appearing at a surface part of the carrier particle section are set to satisfy Pb1/Pa1<1 and Pb2/Pa2>1, so as to provide a higher resistivity to the surface part of the carrier particle than at the inside part of the carrier particle.

* * * * *

UNITED STATES PATENT AND TRADEMARK OFFICE

CERTIFICATE OF CORRECTION

PATENT NO. : 6,010,811
DATED : January 4, 2000
INVENTOR(S) : Yoshinobu Baba et al.

It is certified that error appears in the above-identified patent and that said Letters Patent is hereby corrected as shown below:

Title page [56] References Cited:
OTHER PUBLICATIONS, "No. 255" should read -- No. 225 --.

Column 2:
Line 25, "in case" should read -- in a case --.

Column 4:
Line 32, "reproducing" should read -- reproduce --.

Column 7:
Line 30, "Pb11/Pal<1" should read -- Pb1/Pal<1 --.

Column 8:
Line 61, "THe" should read -- The --.

Column 17:
Line 66, "particle size) = 0.24 pm," should read -- particle size) = 0.24 μm, --.

Column 18:
Line 51, "(negative charge control agent, pale)" should be deleted.

Column 23:
Line 17, "($d_{av}$ = 0.70μm, Rs = $3x10^{14}$ ohm.cm)" should read -- $d_{av}$ = 0.24μm, Rs = $3x10^{14}$ ohm.cm) --.

Column 24:
Line 48, "magnetite" should read -- Magnetite --.

Column 25:
Line 28, "was" should read -- were --.

Column 26:
Line 54, "was" should read -- were --

UNITED STATES PATENT AND TRADEMARK OFFICE

CERTIFICATE OF CORRECTION

PATENT NO. : 6,010,811
DATED : January 4, 2000
INVENTOR(S) : Yoshinobu Baba et al.

It is certified that error appears in the above-identified patent and that said Letters Patent is hereby corrected as shown below:

Column 27:

| | | | | |
|---|---|---|---|---|
| Table 2, " | Carrier attachment | " should read -- | Carrier attachment | -- |
| | o | | o | |
| | o | | o | |
| | ◎ | | ◎ | |
| | o | | o | |
| | o | | o | |
| | o | | o | |
| | O | | o | |
| and " | Fog | " should read -- | Fog | --. |
| | ◎ | | ◎ | |
| | o | | o | |
| | o | | ◎ | |
| | o | | o | |
| | ◎ | | ◎ | |
| | o | | o | |
| | ◎ | | ◎ | |
| | x | | x | |

Column 30:
Line 53, "rb" should read -- $r_b$ — and "rb/ra > 1.0" should read -- $r_b/r_a > 1.0$ --.

Column 32:
Line 15, "ra," should read -- $r_a$, --;
Line 46, "ra," should read -- $r_a$, --;
Line 47, "rb" should read -- $r_b$ --;
Line 48, "rb/ra > 1.0" should read -- $r_b/r_a > 1.0$ --.

UNITED STATES PATENT AND TRADEMARK OFFICE

CERTIFICATE OF CORRECTION

PATENT NO. : 6,010,811
DATED : January 4, 2000
INVENTOR(S) : Yoshinobu Baba et al.

It is certified that error appears in the above-identified patent and that said Letters Patent is hereby corrected as shown below:

Column 33:
Line 11, "ra," should read -- $r_a$, --;
Line 12, "rb" should read -- $r_b$ --;
Line 13, "rb/ra > 1.0" should read -- $r_b/r_a > 1.0$ --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*